US010219665B2

(12) United States Patent
Haegermarck

(10) Patent No.: US 10,219,665 B2
(45) Date of Patent: Mar. 5, 2019

(54) ROBOTIC VACUUM CLEANER WITH PROTRUDING SIDEBRUSH

(71) Applicant: Aktiebolaget Electrolux, Stockholm (SE)

(72) Inventor: Anders Haegermarck, Trångsund (SE)

(73) Assignee: Aktiebolaget Electrolux (SE)

( * ) Notice: Subject to any disclaimer, the term of this patent is extended or adjusted under 35 U.S.C. 154(b) by 244 days.

(21) Appl. No.: 14/784,106

(22) PCT Filed: Apr. 15, 2013

(86) PCT No.: PCT/EP2013/057815

§ 371 (c)(1),
(2) Date: Oct. 13, 2015

(87) PCT Pub. No.: WO2014/169944

PCT Pub. Date: Oct. 23, 2014

(65) Prior Publication Data

US 2016/0073840 A1 Mar. 17, 2016

(51) Int. Cl.
*A47L 9/04* (2006.01)
*A47L 9/00* (2006.01)
(Continued)

(52) U.S. Cl.
CPC ..... *A47L 9/0461* (2013.01); *A47L 5/12* (2013.01); *A47L 9/00* (2013.01); *A47L 9/0472* (2013.01); *A47L 9/0477* (2013.01); *A47L 9/0488* (2013.01); *A47L 11/4011* (2013.01); *A47L 11/4072* (2013.01); *A47L 2201/00* (2013.01); *A47L 2201/04* (2013.01)

(58) Field of Classification Search
CPC .... A47L 9/0461; A47L 9/0466; A47L 9/0472; A47L 9/0477; A47L 11/4011; A47L 2201/00; A47L 2201/04
See application file for complete search history.

(56) References Cited

U.S. PATENT DOCUMENTS 1,286,321 A 12/1918 Hoover
1,401,007 A 12/1921 Staples
(Continued)

FOREIGN PATENT DOCUMENTS

CA 2154758 6/1995
CN 1116818 2/1996
(Continued)

OTHER PUBLICATIONS

Chinese Office Action for Chinese Application No. 20130075510.9, dated Feb. 6, 2017 with translation, 14pages.
(Continued)

*Primary Examiner* — Christopher M Koehler
*Assistant Examiner* — Henry Hong
(74) *Attorney, Agent, or Firm* — RatnerPrestia

(57) ABSTRACT

A robotic cleaning device having main body, at least one driving wheel to move the robotic cleaning device across a surface to be cleaned, and a brush for removing debris from the surface to be cleaned. The brush is arranged on a protrusion in a front end portion of the main body. The widest part of the main body is located between the protrusion and the opposite sidewall of the main body, and within the front end portion of the main body.

19 Claims, 9 Drawing Sheets

(51) Int. Cl.
*A47L 5/12* (2006.01)
*A47L 11/40* (2006.01)

(56) References Cited

U.S. PATENT DOCUMENTS

| | | | |
|---|---|---|---|
| 3,010,129 | A | 11/1961 | Moore |
| 3,233,274 | A | 2/1966 | Kroll |
| 3,550,714 | A | 12/1970 | Bellinger |
| 3,570,227 | A | 3/1971 | Bellinger |
| 3,713,505 | A | 1/1973 | Muller |
| 3,837,028 | A | 9/1974 | Bridge |
| 4,028,765 | A | 6/1977 | Liebscher |
| 4,036,147 | A | 7/1977 | Westing |
| 4,114,711 | A | 9/1978 | Wilkins |
| 4,119,900 | A | 10/1978 | Kremnitz |
| 4,306,174 | A | 12/1981 | Mourier |
| 4,306,329 | A | 12/1981 | Yokoi |
| 4,369,543 | A | 1/1983 | Chen |
| 4,502,173 | A | 3/1985 | Patzold |
| 4,627,511 | A | 12/1986 | Yajima |
| 4,647,209 | A | 3/1987 | Neukomm |
| 4,800,978 | A | 1/1989 | Wasa |
| 4,822,450 | A | 4/1989 | Davis |
| 4,825,091 | A | 4/1989 | Breyer |
| 4,836,905 | A | 6/1989 | Davis |
| 4,838,990 | A | 6/1989 | Jucha |
| 4,842,686 | A | 6/1989 | Davis |
| 4,849,067 | A | 7/1989 | Jucha |
| 4,854,000 | A | 8/1989 | Takimoto |
| 4,864,511 | A | 9/1989 | Moy |
| 4,872,938 | A | 10/1989 | Davis |
| 4,878,003 | A | 10/1989 | Knepper |
| 4,886,570 | A | 12/1989 | Davis |
| 4,918,607 | A | 4/1990 | Wible |
| 4,919,224 | A | 4/1990 | Shyu |
| 4,922,559 | A | 5/1990 | Wall |
| 4,959,192 | A | 9/1990 | Trundle |
| 4,962,453 | A | 10/1990 | Pong |
| 4,989,818 | A | 2/1991 | Trundle |
| 5,001,635 | A | 3/1991 | Yasutomi |
| 5,006,302 | A | 4/1991 | Trundle |
| 5,023,444 | A | 6/1991 | Ohman |
| 5,032,775 | A | 7/1991 | Mizuno |
| 5,034,673 | A | 7/1991 | Shoji |
| 5,042,861 | A | 8/1991 | Trundle |
| 5,045,118 | A | 9/1991 | Mason |
| 5,086,535 | A | 2/1992 | Grossmeyer |
| 5,095,577 | A | 3/1992 | Jonas |
| 5,107,946 | A | 4/1992 | Kamimura |
| 5,155,683 | A | 10/1992 | Rahim |
| 5,243,732 | A | 9/1993 | Koharagi |
| 5,245,177 | A | 9/1993 | Schiller |
| 5,276,933 | A | 1/1994 | Hennessey |
| 5,279,672 | A | 1/1994 | Betker |
| 5,293,955 | A | 3/1994 | Lee |
| 5,307,273 | A | 4/1994 | Oh |
| 5,309,592 | A | 5/1994 | Hiratsuka |
| 5,341,540 | A | 8/1994 | Soupert |
| 5,345,639 | A | 9/1994 | Tanoue |
| 5,349,378 | A | 9/1994 | Maali |
| 5,353,224 | A | 10/1994 | Lee |
| 5,367,458 | A | 11/1994 | Roberts et al. |
| 5,369,347 | A | 11/1994 | Yoo |
| 5,377,106 | A | 12/1994 | Drunk |
| 5,390,627 | A | 2/1995 | van der Berg |
| 5,398,632 | A | 3/1995 | Goldbach |
| 5,402,051 | A | 3/1995 | Fujiwara |
| 5,440,216 | A | 8/1995 | Kim |
| 5,444,965 | A | 8/1995 | Colens |
| 5,446,356 | A | 8/1995 | Kim |
| 5,454,129 | A | 10/1995 | Kell |
| 5,518,552 | A | 5/1996 | Tanoue |
| 5,534,762 | A | 7/1996 | Kim |
| 5,548,511 | A | 8/1996 | Bancroft |
| 5,560,077 | A | 10/1996 | Crotchett |
| 5,568,589 | A | 10/1996 | Hwang |
| 5,621,291 | A | 4/1997 | Lee |
| 5,646,494 | A | 7/1997 | Han |
| 5,666,689 | A | 9/1997 | Andersen |
| 5,682,313 | A | 10/1997 | Edlund |
| 5,682,640 | A | 11/1997 | Han |
| 5,687,294 | A | 11/1997 | Jeong |
| 5,698,957 | A | 12/1997 | Sowada |
| 5,745,946 | A | 5/1998 | Thrasher |
| 5,758,298 | A | 5/1998 | Guldner |
| 5,778,554 | A | 7/1998 | Jones |
| 5,781,960 | A | 7/1998 | Kilstrom |
| 5,787,545 | A | 8/1998 | Colens |
| 5,815,880 | A | 10/1998 | Nakanishi |
| 5,825,981 | A | 10/1998 | Matsuda |
| 5,841,259 | A | 11/1998 | Kim |
| 5,852,984 | A | 12/1998 | Matsuyama |
| 5,867,800 | A | 2/1999 | Leif |
| 5,890,250 | A | 4/1999 | Lange |
| 5,896,488 | A | 4/1999 | Jeong |
| 5,903,124 | A | 5/1999 | Kawakami |
| 5,926,909 | A | 7/1999 | McGee |
| 5,933,902 | A | 8/1999 | Frey |
| 5,935,179 | A | 8/1999 | Kleiner |
| 5,940,927 | A | 8/1999 | Haegermarck |
| 5,942,869 | A | 8/1999 | Katou |
| 5,947,051 | A | 9/1999 | Geiger |
| 5,959,423 | A | 9/1999 | Nakanishi |
| 5,959,424 | A | 9/1999 | Elkmann |
| 5,966,765 | A | 10/1999 | Hamada |
| RE36,391 | E | 11/1999 | vandenBerg |
| 5,987,696 | A | 11/1999 | van der Lely |
| 5,991,951 | A | 11/1999 | Kubo |
| 5,995,884 | A | 11/1999 | Allen |
| 5,997,670 | A | 12/1999 | Walter |
| 5,999,865 | A | 12/1999 | Bloomquist et al. |
| 6,012,470 | A | 1/2000 | Jones |
| 6,024,107 | A | 2/2000 | Jones |
| 6,064,926 | A | 5/2000 | Sarangapani |
| 6,076,662 | A | 6/2000 | Bahten |
| 6,082,377 | A | 7/2000 | Frey |
| 6,124,694 | A | 9/2000 | Bancroft |
| 6,142,252 | A | 11/2000 | Kinto |
| 6,176,067 | B1 | 1/2001 | Bahten |
| 6,213,136 | B1 | 4/2001 | Jones |
| 6,226,830 | B1 | 5/2001 | Hendriks |
| 6,230,360 | B1 | 5/2001 | Singleton |
| 6,251,551 | B1 | 6/2001 | Kunze-Concewitz |
| 6,255,793 | B1 | 7/2001 | Peless |
| 6,263,989 | B1 | 7/2001 | Won |
| 6,300,737 | B1 | 10/2001 | Bergvall |
| 6,311,366 | B1 | 11/2001 | Sepke |
| 6,327,741 | B1 | 12/2001 | Reed |
| 6,339,735 | B1 | 1/2002 | Peless |
| 6,358,325 | B1 | 3/2002 | Andreas |
| 6,360,801 | B1 | 3/2002 | Walter |
| 6,370,452 | B1 | 4/2002 | Pfister |
| 6,370,453 | B2 | 4/2002 | Sommer |
| 6,381,801 | B1 | 5/2002 | Clemons, Sr. |
| 6,389,329 | B1 | 5/2002 | Colens |
| 6,413,149 | B1 | 7/2002 | Wade |
| 6,417,641 | B2 | 7/2002 | Peless |
| 6,431,296 | B1 | 8/2002 | Won |
| 6,438,456 | B1 | 8/2002 | Feddema |
| 6,443,509 | B1 | 9/2002 | Levin |
| 6,457,199 | B1 | 10/2002 | Frost |
| 6,457,206 | B1 | 10/2002 | Judson |
| 6,459,955 | B1 | 10/2002 | Bartsch |
| 6,465,982 | B1 | 10/2002 | Bergvall |
| 6,481,515 | B1 | 11/2002 | Kirkpatrick |
| 6,482,678 | B1 | 11/2002 | Frost |
| 6,493,612 | B1 | 12/2002 | Bisset |
| 6,493,613 | B2 | 12/2002 | Peless |
| 6,496,754 | B2 | 12/2002 | Song |
| 6,504,610 | B1 | 1/2003 | Bauer |
| 6,519,804 | B1 | 2/2003 | Vujik |
| 6,525,509 | B1 | 2/2003 | Petersson |
| D471,243 | S | 3/2003 | Cioffi |
| 6,532,404 | B2 | 3/2003 | Colens |

(56) References Cited

U.S. PATENT DOCUMENTS

| | | | |
|---|---|---|---|
| 6,535,793 | B2 | 3/2003 | Allard |
| 6,571,415 | B2 | 6/2003 | Gerber |
| 6,580,246 | B2 | 6/2003 | Jacobs |
| 6,581,239 | B1 | 6/2003 | Dyson |
| 6,594,844 | B2 | 7/2003 | Jones |
| 6,597,143 | B2 | 7/2003 | Song |
| 6,601,265 | B1 | 8/2003 | Burlington |
| 6,605,156 | B1 | 8/2003 | Clark |
| 6,609,962 | B1 | 8/2003 | Wakabayashi |
| 6,611,120 | B2 | 8/2003 | Song |
| 6,611,318 | B2 | 8/2003 | LaPolice |
| 6,615,108 | B1 | 9/2003 | Peless |
| 6,615,885 | B1 | 9/2003 | Ohm |
| 6,633,150 | B1 | 10/2003 | Wallach |
| 6,637,446 | B2 | 10/2003 | Frost |
| 6,658,325 | B2 | 12/2003 | Zweig |
| 6,661,239 | B1 | 12/2003 | Ozick |
| 6,662,889 | B2 | 12/2003 | De Fazio |
| 6,667,592 | B2 | 12/2003 | Jacobs |
| 6,668,951 | B2 | 12/2003 | Won |
| 6,671,592 | B1 | 12/2003 | Bisset |
| 6,690,134 | B1 | 2/2004 | Jones |
| 6,726,823 | B1 | 4/2004 | Wang |
| 6,732,826 | B2 | 5/2004 | Song |
| 6,745,431 | B2 | 6/2004 | Dijksman |
| 6,748,297 | B2 | 6/2004 | Song |
| 6,769,004 | B2 | 7/2004 | Barrett |
| 6,774,596 | B1 | 8/2004 | Bisset |
| 6,775,871 | B1 | 8/2004 | Finch |
| 6,781,338 | B2 | 8/2004 | Jones |
| 6,809,490 | B2 | 10/2004 | Jones |
| 6,810,305 | B2 | 10/2004 | Kirkpatrick, Jr. |
| 6,820,801 | B2 | 11/2004 | Kaneko |
| 6,841,963 | B2 | 1/2005 | Song |
| 6,845,297 | B2 | 1/2005 | Allard |
| 6,850,024 | B2 | 2/2005 | Peless |
| 6,859,010 | B2 | 2/2005 | Jeon |
| 6,859,976 | B2 | 3/2005 | Plankenhorn |
| 6,860,206 | B1 | 3/2005 | Rudakevych |
| 6,868,307 | B2 | 3/2005 | Song |
| 6,869,633 | B2 | 3/2005 | Sus |
| 6,870,792 | B2 | 3/2005 | Chiappetta |
| 6,882,334 | B1 | 4/2005 | Meyer |
| 6,883,201 | B2 | 4/2005 | Jones |
| 6,885,912 | B2 | 4/2005 | Peless |
| 6,901,624 | B2 | 6/2005 | Mori |
| 6,925,679 | B2 | 8/2005 | Wallach |
| D510,066 | S | 9/2005 | Hickey |
| 6,938,298 | B2 | 9/2005 | Aasen |
| 6,939,208 | B2 | 9/2005 | Kamimura |
| 6,940,291 | B1 | 9/2005 | Ozick |
| 6,941,199 | B1 | 9/2005 | Bottomley |
| 6,942,548 | B2 | 9/2005 | Wada |
| 6,956,348 | B2 | 10/2005 | Landry |
| 6,957,712 | B2 | 10/2005 | Song |
| 6,964,312 | B2 | 11/2005 | Maggio |
| 6,965,209 | B2 | 11/2005 | Jones |
| 6,967,275 | B2 | 11/2005 | Ozick |
| 6,971,140 | B2 | 12/2005 | Kim |
| 6,971,141 | B1 | 12/2005 | Tak |
| 6,984,952 | B2 | 1/2006 | Peless |
| 7,000,623 | B2 | 2/2006 | Welsh |
| 7,004,269 | B2 | 2/2006 | Song |
| 7,013,200 | B2 | 3/2006 | Wakui |
| 7,013,527 | B2 | 3/2006 | Thomas, Sr. |
| 7,015,831 | B2 | 3/2006 | Karlsson |
| 7,024,278 | B2 | 4/2006 | Chiappetta |
| 7,031,805 | B2 | 4/2006 | Lee |
| 7,040,968 | B2 | 5/2006 | Kamimura |
| 7,042,342 | B2 | 5/2006 | Luo |
| 7,043,794 | B2 | 5/2006 | Conner |
| 7,050,926 | B2 | 5/2006 | Theurer et al. |
| 7,053,578 | B2 | 5/2006 | Diehl et al. |
| 7,053,580 | B2 | 5/2006 | Aldred |
| 7,054,716 | B2 | 5/2006 | McKee |
| 7,059,012 | B2 | 6/2006 | Song |
| 7,079,923 | B2 | 7/2006 | Abramson |
| 7,082,350 | B2 | 7/2006 | Skoog |
| D526,753 | S | 8/2006 | Tani |
| 7,085,624 | B2 | 8/2006 | Aldred |
| 7,103,449 | B2 | 9/2006 | Woo |
| 7,113,847 | B2 | 9/2006 | Chmura |
| 7,117,067 | B2 | 10/2006 | McLurkin |
| 7,133,745 | B2 | 11/2006 | Wang |
| 7,134,164 | B2 | 11/2006 | Alton |
| 7,135,992 | B2 | 11/2006 | Karlsson |
| 7,143,696 | B2 | 12/2006 | Rudakevych |
| 7,145,478 | B2 | 12/2006 | Goncalves |
| 7,150,068 | B1 | 12/2006 | Ragner |
| 7,155,308 | B2 | 12/2006 | Jones |
| 7,155,309 | B2 | 12/2006 | Peless |
| 7,162,338 | B2 | 1/2007 | Goncalves |
| 7,167,775 | B2 | 1/2007 | Abramson |
| 7,173,391 | B2 | 2/2007 | Jones |
| 7,174,238 | B1 | 2/2007 | Zweig |
| 7,177,737 | B2 | 2/2007 | Karlsson |
| 7,184,586 | B2 | 2/2007 | Jeon |
| 7,185,396 | B2 | 3/2007 | Im |
| 7,185,397 | B2 | 3/2007 | Stuchlik |
| 7,188,000 | B2 | 3/2007 | Chiappetta |
| 7,196,487 | B2 | 3/2007 | Jones |
| 7,199,711 | B2 | 4/2007 | Field |
| 7,200,892 | B2 | 4/2007 | Kim |
| 7,202,630 | B2 | 4/2007 | Dan |
| 7,206,677 | B2 | 4/2007 | Hulden |
| 7,207,081 | B2 | 4/2007 | Gerber |
| 7,208,892 | B2 | 4/2007 | Tondra |
| 7,213,298 | B2 | 5/2007 | Cipolla |
| 7,213,663 | B2 | 5/2007 | Kim |
| 7,222,390 | B2 | 5/2007 | Cipolla |
| 7,225,500 | B2 | 6/2007 | Diehl |
| 7,237,298 | B2 | 7/2007 | Reindle |
| 7,240,396 | B2 | 7/2007 | Thomas, Sr. |
| 7,246,405 | B2 | 7/2007 | Yan |
| 7,248,951 | B2 | 7/2007 | Hulden |
| 7,251,853 | B2 | 8/2007 | Park |
| 7,254,464 | B1 | 8/2007 | McLurkin |
| 7,254,859 | B2 | 8/2007 | Gerber |
| 7,269,877 | B2 | 9/2007 | Tondra |
| 7,272,467 | B2 | 9/2007 | Goncalves |
| 7,272,868 | B2 | 9/2007 | Im |
| 7,274,167 | B2 | 9/2007 | Kim |
| 7,275,280 | B2 | 10/2007 | Haegermarck |
| 7,288,912 | B2 | 10/2007 | Landry |
| D556,961 | S | 12/2007 | Swyst |
| 7,303,776 | B2 | 12/2007 | Sus |
| 7,324,870 | B2 | 1/2008 | Lee |
| 7,331,436 | B1 | 2/2008 | Pack |
| 7,332,890 | B2 | 2/2008 | Cohen |
| 7,343,221 | B2 | 3/2008 | Ann |
| 7,343,719 | B2 | 3/2008 | Sus |
| 7,346,428 | B1 | 3/2008 | Huffman |
| 7,349,759 | B2 | 3/2008 | Peless |
| 7,359,766 | B2 | 4/2008 | Jeon |
| 7,363,994 | B1 | 4/2008 | DeFazio |
| 7,369,460 | B2 | 5/2008 | Chiappetta |
| 7,372,004 | B2 | 5/2008 | Buchner |
| 7,388,343 | B2 | 6/2008 | Jones |
| 7,389,156 | B2 | 6/2008 | Ziegler |
| 7,389,166 | B2 | 6/2008 | Harwig |
| 7,403,360 | B2 | 7/2008 | Cunningham |
| 7,412,748 | B2 | 8/2008 | Lee |
| 7,417,404 | B2 | 8/2008 | Lee |
| 7,418,762 | B2 | 9/2008 | Arai |
| 7,424,766 | B2 | 9/2008 | Reindle |
| 7,429,843 | B2 | 9/2008 | Jones |
| 7,430,455 | B2 | 9/2008 | Casey |
| 7,438,766 | B2 | 10/2008 | Song |
| 7,441,298 | B2 | 10/2008 | Svendsen |
| 7,444,206 | B2 | 10/2008 | Abramson |
| 7,448,113 | B2 | 11/2008 | Jones |
| 7,459,871 | B2 | 12/2008 | Landry |
| 7,464,157 | B2 | 12/2008 | Okude |
| 7,474,941 | B2 | 1/2009 | Kim |

(56) References Cited

U.S. PATENT DOCUMENTS

| | | | |
|---|---|---|---|
| 7,480,958 | B2 | 1/2009 | Song |
| 7,480,960 | B2 | 1/2009 | Kim |
| D586,959 | S | 2/2009 | Geringer |
| 7,489,277 | B2 | 2/2009 | Sung |
| 7,489,985 | B2 | 2/2009 | Ko |
| 7,499,774 | B2 | 3/2009 | Barrett |
| 7,499,775 | B2 | 3/2009 | Filippov |
| 7,499,776 | B2 | 3/2009 | Allard |
| 7,499,804 | B2 | 3/2009 | Svendsen |
| 7,503,096 | B2 | 3/2009 | Lin |
| 7,515,991 | B2 | 4/2009 | Egawa |
| D593,265 | S | 5/2009 | Carr |
| 7,539,557 | B2 | 5/2009 | Yamauchi |
| 7,546,891 | B2 | 6/2009 | Won |
| 7,546,912 | B1 | 6/2009 | Pack |
| 7,555,363 | B2 | 6/2009 | Augenbraun |
| 7,556,108 | B2 | 7/2009 | Won |
| 7,559,269 | B2 | 7/2009 | Rudakevych |
| 7,564,571 | B2 | 7/2009 | Karabassi |
| 7,566,839 | B2 | 7/2009 | Hukuba |
| 7,567,052 | B2 | 7/2009 | Jones |
| 7,568,259 | B2 | 8/2009 | Yan |
| 7,568,536 | B2 | 8/2009 | Yu |
| 7,571,511 | B2 | 8/2009 | Jones |
| 7,573,403 | B2 | 8/2009 | Goncalves |
| 7,574,282 | B2 | 8/2009 | Petersson |
| 7,578,020 | B2 | 8/2009 | Jaworski |
| 7,579,803 | B2 | 8/2009 | Jones |
| 7,581,282 | B2 | 9/2009 | Woo |
| 7,597,162 | B2 | 10/2009 | Won |
| 7,600,521 | B2 | 10/2009 | Woo |
| 7,600,593 | B2 | 10/2009 | Filippov |
| 7,603,744 | B2 | 10/2009 | Reindle |
| 7,604,675 | B2 | 10/2009 | Makarov |
| 7,610,651 | B2 | 11/2009 | Baek |
| 7,613,543 | B2 | 11/2009 | Petersson |
| 7,620,476 | B2 | 11/2009 | Morse |
| 7,636,982 | B2 | 12/2009 | Jones |
| 7,647,144 | B2 | 1/2010 | Haegermarck |
| 7,650,666 | B2 | 1/2010 | Jang |
| 7,654,348 | B2 | 2/2010 | Ohm |
| 7,660,650 | B2 | 2/2010 | Kawagoe |
| 7,663,333 | B2 | 2/2010 | Jones |
| 7,673,367 | B2 | 3/2010 | Kim |
| 7,679,532 | B2 | 3/2010 | Karlsson |
| 7,688,676 | B2 | 3/2010 | Chiappetta |
| 7,693,654 | B1 | 4/2010 | Dietsch |
| 7,697,141 | B2 | 4/2010 | Jones |
| 7,706,917 | B1 | 4/2010 | Chiappetta |
| 7,706,921 | B2 | 4/2010 | Jung |
| 7,709,497 | B2 | 5/2010 | Christensen, IV |
| 7,711,450 | B2 | 5/2010 | Im |
| 7,720,572 | B2 | 5/2010 | Ziegler |
| 7,721,829 | B2 | 5/2010 | Lee |
| 7,729,801 | B2 | 6/2010 | Abramson |
| 7,749,294 | B2 | 7/2010 | Oh |
| 7,751,940 | B2 | 7/2010 | Lee |
| 7,761,954 | B2 | 7/2010 | Ziegler |
| 7,765,635 | B2 | 8/2010 | Park |
| 7,765,638 | B2 | 8/2010 | Pineschi et al. |
| 7,769,490 | B2 | 8/2010 | Abramson |
| 7,774,158 | B2 | 8/2010 | Domingues Goncalves |
| 7,779,504 | B2 | 8/2010 | Lee |
| 7,780,796 | B2 | 8/2010 | Shim |
| 7,784,139 | B2 | 8/2010 | Sawalski |
| 7,784,570 | B2 | 8/2010 | Couture |
| 7,785,544 | B2 | 8/2010 | Alward |
| 7,787,991 | B2 | 8/2010 | Jeung |
| 7,793,614 | B2 | 9/2010 | Ericsson |
| 7,801,645 | B2 | 9/2010 | Taylor |
| 7,805,220 | B2 | 9/2010 | Taylor |
| 7,827,653 | B1 | 11/2010 | Liu |
| 7,832,048 | B2 | 11/2010 | Harwig |
| 7,835,529 | B2 | 11/2010 | Hernandez |
| 7,843,431 | B2 | 11/2010 | Robbins |
| 7,844,364 | B2 | 11/2010 | McLurkin |
| 7,849,555 | B2 | 12/2010 | Hahm |
| 7,856,291 | B2 | 12/2010 | Jung |
| 7,860,608 | B2 | 12/2010 | Lee |
| 7,861,365 | B2 | 1/2011 | Sun |
| 7,861,366 | B2 | 1/2011 | Hahm |
| 7,873,437 | B2 | 1/2011 | Aldred |
| 7,877,166 | B2 | 1/2011 | Harwig |
| 7,886,399 | B2 | 2/2011 | Dayton |
| 7,890,210 | B2 | 2/2011 | Choi |
| 7,891,045 | B2 | 2/2011 | Kim |
| 7,891,289 | B2 | 2/2011 | Day |
| 7,891,446 | B2 | 2/2011 | Couture |
| 7,894,951 | B2 | 2/2011 | Norris |
| 7,916,931 | B2 | 3/2011 | Lee |
| 7,920,941 | B2 | 4/2011 | Park |
| 7,921,506 | B2 | 4/2011 | Baek |
| 7,926,598 | B2 | 4/2011 | Rudakevych |
| 7,934,571 | B2 | 5/2011 | Chiu |
| 7,937,800 | B2 | 5/2011 | Yan |
| 7,942,107 | B2 | 5/2011 | Vosburgh |
| 7,957,837 | B2 | 6/2011 | Ziegler |
| 7,962,997 | B2 | 6/2011 | Chung |
| 7,966,339 | B2 | 6/2011 | Kim |
| 7,975,790 | B2 | 7/2011 | Kim |
| 7,979,175 | B2 | 7/2011 | Allard |
| 7,979,945 | B2 | 7/2011 | Dayton |
| 7,981,455 | B2 | 7/2011 | Sus |
| 7,997,118 | B2 | 8/2011 | Mecca |
| 8,001,651 | B2 | 8/2011 | Chang |
| 8,007,221 | B1 | 8/2011 | More |
| 8,010,229 | B2 | 8/2011 | Kim |
| 8,019,223 | B2 | 9/2011 | Hudson |
| 8,020,657 | B2 | 9/2011 | Allard |
| 8,032,978 | B2 | 10/2011 | Haegermarck |
| 8,034,390 | B2 | 10/2011 | Sus |
| 8,042,663 | B1 | 10/2011 | Pack |
| 8,046,103 | B2 | 10/2011 | Abramson |
| 8,061,461 | B2 | 11/2011 | Couture |
| 8,065,778 | B2 | 11/2011 | Kim |
| 8,073,439 | B2 | 12/2011 | Stromberg |
| 8,074,752 | B2 | 12/2011 | Rudakevych |
| 8,078,338 | B2 | 12/2011 | Pack |
| 8,079,432 | B2 | 12/2011 | Ohm |
| 8,082,836 | B2 | 12/2011 | More |
| 8,086,419 | B2 | 12/2011 | Goncalves |
| 8,087,117 | B2 | 1/2012 | Kapoor |
| 8,095,238 | B2 | 1/2012 | Jones |
| 8,095,336 | B2 | 1/2012 | Goncalves |
| 8,107,318 | B2 | 1/2012 | Chiappetta |
| 8,108,092 | B2 | 1/2012 | Phillips |
| 8,109,191 | B1 | 2/2012 | Rudakevych |
| 8,112,942 | B2 | 2/2012 | Bohm |
| 8,113,304 | B2 | 2/2012 | Won |
| 8,122,982 | B2 | 2/2012 | Morey |
| 8,127,396 | B2 | 3/2012 | Mangiardi |
| 8,127,399 | B2 | 3/2012 | Dilger |
| 8,127,704 | B2 | 3/2012 | Vosburgh |
| 8,136,200 | B2 | 3/2012 | Splinter |
| 8,150,650 | B2 | 4/2012 | Goncalves |
| D659,311 | S | 5/2012 | Geringer |
| 8,166,904 | B2 | 5/2012 | Israel |
| 8,195,333 | B2 | 6/2012 | Ziegler |
| 8,196,251 | B2 | 6/2012 | Lynch |
| 8,199,109 | B2 | 6/2012 | Robbins |
| 8,200,600 | B2 | 6/2012 | Rosenstein |
| 8,200,700 | B2 | 6/2012 | Moore |
| 8,237,389 | B2 | 8/2012 | Fitch |
| 8,237,920 | B2 | 8/2012 | Jones |
| 8,239,992 | B2 | 8/2012 | Schnittman |
| 8,244,469 | B2 | 8/2012 | Cheung |
| 8,253,368 | B2 | 8/2012 | Landry |
| 8,255,092 | B2 | 8/2012 | Phillips |
| 8,256,542 | B2 | 9/2012 | Couture |
| 8,265,793 | B2 | 9/2012 | Cross |
| 8,274,406 | B2 | 9/2012 | Karlsson |
| 8,281,703 | B2 | 10/2012 | Moore |
| 8,281,731 | B2 | 10/2012 | Vosburgh |
| 8,290,619 | B2 | 10/2012 | McLurkin |

(56) References Cited

U.S. PATENT DOCUMENTS 8,292,007 B2 10/2012 DeFazio
8,295,125 B2 10/2012 Chiappetta
D670,877 S 11/2012 Geringer
8,308,529 B2 11/2012 DAmbra
8,311,674 B2 11/2012 Abramson
8,316,971 B2 11/2012 Couture
8,318,499 B2 11/2012 Fritchie
D672,928 S 12/2012 Swett
8,322,470 B2 12/2012 Ohm
8,326,469 B2 12/2012 Phillips
8,327,960 B2 12/2012 Couture
8,336,479 B2 12/2012 Vosburgh
8,342,271 B2 1/2013 Filippov
8,347,088 B2 1/2013 Moore
8,347,444 B2 1/2013 Schnittman
8,350,810 B2 1/2013 Robbins
8,353,373 B2 1/2013 Rudakevych
8,364,309 B1 1/2013 Bailey
8,364,310 B2 1/2013 Jones
8,365,848 B2 2/2013 Won
8,368,339 B2 2/2013 Jones
8,370,985 B2 2/2013 Schnittman
8,374,721 B2 2/2013 Halloran
8,375,838 B2 2/2013 Rudakevych
8,378,613 B2 2/2013 Landry
8,380,350 B2 2/2013 Ozick
8,382,906 B2 2/2013 Konandreas
8,386,081 B2 2/2013 Landry
8,387,193 B2 3/2013 Ziegler
8,390,251 B2 3/2013 Cohen
8,392,021 B2 3/2013 Konandreas
8,396,592 B2 3/2013 Jones
8,396,611 B2 3/2013 Phillips
8,402,586 B2 3/2013 Lavabre
8,408,956 B1 4/2013 Vosburgh
8,412,377 B2 4/2013 Casey
8,413,752 B2 4/2013 Page
8,417,188 B1 4/2013 Vosburgh
8,417,383 B2 4/2013 Ozick
8,418,303 B2 4/2013 Kapoor
8,418,642 B2 4/2013 Vosburgh
8,428,778 B2 4/2013 Landry
8,433,442 B2 4/2013 Friedman
D682,362 S 5/2013 Mozeika
8,438,694 B2 5/2013 Kim
8,438,695 B2 5/2013 Gilbert, Jr.
8,438,698 B2 5/2013 Kim
8,447,440 B2 5/2013 Phillips
8,447,613 B2 5/2013 Hussey
8,452,448 B2 5/2013 Pack
8,453,289 B2 6/2013 Lynch
8,456,125 B2 6/2013 Landry
8,461,803 B2 6/2013 Cohen
8,463,438 B2 6/2013 Jones
8,473,140 B2 6/2013 Norris
8,474,090 B2 7/2013 Jones
8,478,442 B2 7/2013 Casey
8,485,330 B2 7/2013 Pack
8,505,158 B2 8/2013 Han
8,508,388 B2 8/2013 Karlsson
8,515,578 B2 8/2013 Chiappetta
8,516,651 B2 8/2013 Jones
8,525,995 B2 9/2013 Jones
8,527,113 B2 9/2013 Yamauchi
8,528,157 B2 9/2013 Schnittman
8,528,162 B2 9/2013 Tang
8,528,673 B2 9/2013 More
8,532,822 B2 9/2013 Abramson
8,533,144 B1 9/2013 Reeser
8,534,983 B2 9/2013 Schoenfeld
8,543,562 B2 9/2013 Mule
8,548,626 B2 10/2013 Steltz
8,551,254 B2 10/2013 Dayton
8,551,421 B2 10/2013 Luchinger
8,565,920 B2 10/2013 Casey
8,572,799 B2 11/2013 Won
8,584,305 B2 11/2013 Won
8,584,306 B2 11/2013 Chung
8,584,307 B2 11/2013 Won
8,594,840 B1 11/2013 Chiappetta
8,598,829 B2 12/2013 Landry
8,599,645 B2 12/2013 Chiappetta
8,600,553 B2 12/2013 Svendsen
8,606,401 B2 12/2013 Ozick
8,634,956 B1 1/2014 Chiappetta
8,634,958 B1 1/2014 Chiappetta
8,666,523 B2 3/2014 Kim
8,671,513 B2 3/2014 Yoo et al.
8,732,895 B2 5/2014 Cunningham
8,741,013 B2 6/2014 Swett et al.
8,743,286 B2 6/2014 Hasegawa
8,745,194 B2 6/2014 Uribe-Etxebarria Jimenez
8,755,936 B2 6/2014 Friedman
8,761,931 B2 6/2014 Halloran
8,763,200 B2 7/2014 Kim
8,774,970 B2 7/2014 Knopow
8,798,791 B2 8/2014 Li
8,798,792 B2 8/2014 Park
8,799,258 B2 8/2014 Mule
8,838,274 B2 9/2014 Jones
8,839,477 B2 9/2014 Schnittman
8,843,245 B2 9/2014 Choe
8,855,914 B1 10/2014 Alexander
8,874,264 B1 10/2014 Chiappetta
8,881,339 B2 11/2014 Gilbert, Jr. et al.
8,924,042 B2 12/2014 Kim
8,961,695 B2 2/2015 Romanov
8,985,127 B2 3/2015 Konandreas
8,996,172 B2 3/2015 Shah et al.
9,033,079 B2 5/2015 Shin
9,037,396 B2 5/2015 Pack
9,144,361 B2 9/2015 Landry
9,360,300 B2 6/2016 DiBernado
10,045,675 B2 8/2018 Haegermarck
2001/0004719 A1 6/2001 Sommer
2001/0037163 A1 11/2001 Allard
2002/0016649 A1 2/2002 Jones
2002/0091466 A1 7/2002 Song
2002/0108635 A1 8/2002 Marrero
2002/0121288 A1 9/2002 Marrero
2002/0121561 A1 9/2002 Marrero
2002/0164932 A1 11/2002 Kamimura
2002/0174506 A1 11/2002 Wallach
2002/0185071 A1 12/2002 Guo
2002/0189871 A1 12/2002 Won
2003/0000034 A1 1/2003 Welsh
2003/0025472 A1 2/2003 Jones
2003/0030398 A1 2/2003 Jacobs
2003/0120972 A1 6/2003 Matsushima
2003/0159223 A1 8/2003 Plankenhorn
2003/0167000 A1 9/2003 Mullick
2003/0229421 A1 12/2003 Chmura
2004/0020000 A1 2/2004 Jones
2004/0031111 A1 2/2004 Porchia
2004/0031121 A1 2/2004 Martin
2004/0034952 A1 2/2004 Ho
2004/0049877 A1 3/2004 Jones
2004/0049878 A1 3/2004 Thomas
2004/0074038 A1 4/2004 Im
2004/0074039 A1 4/2004 Kim
2004/0098167 A1 5/2004 Yi
2004/0111184 A1 6/2004 Chiappetta
2004/0111827 A1 6/2004 Im
2004/0167667 A1 8/2004 Goncalves
2004/0181896 A1 9/2004 Egawa
2004/0182839 A1 9/2004 Denney
2004/0182840 A1 9/2004 Denney
2004/0185011 A1 9/2004 Alexander
2004/0187249 A1 9/2004 Jones
2004/0207355 A1 10/2004 Jones
2004/0208212 A1 10/2004 Denney
2004/0210343 A1 10/2004 Kim
2004/0220707 A1 11/2004 Pallister
2005/0010331 A1 1/2005 Taylor

(56) References Cited

U.S. PATENT DOCUMENTS

2005/0015912 A1 1/2005 Kim
2005/0015915 A1 1/2005 Thomas
2005/0028315 A1 2/2005 Thomas
2005/0028316 A1 2/2005 Thomas
2005/0042151 A1 2/2005 Alward
2005/0065662 A1 3/2005 Reindle
2005/0085947 A1 4/2005 Aldred
2005/0088643 A1 4/2005 Anderson
2005/0156562 A1 7/2005 Cohen
2005/0166354 A1 8/2005 Uehigashi
2005/0191949 A1 9/2005 Kamimura
2005/0217061 A1 10/2005 Reindle
2005/0223514 A1 10/2005 Stuchlik
2005/0229340 A1 10/2005 Sawalski
2005/0230166 A1 10/2005 Petersson
2005/0234611 A1 10/2005 Uehigashi
2005/0251292 A1 11/2005 Casey
2005/0251457 A1 11/2005 Kashiwagi
2005/0251947 A1 11/2005 Lee
2005/0267629 A1 12/2005 Petersson
2005/0278888 A1 12/2005 Reindle
2005/0287038 A1 12/2005 Dubrovsky
2006/0009879 A1 1/2006 Lynch
2006/0010799 A1 1/2006 Bohm
2006/0020369 A1 1/2006 Taylor
2006/0028306 A1 2/2006 Hukuba
2006/0032013 A1 2/2006 Kim
2006/0045981 A1 3/2006 Tsushi
2006/0095158 A1 5/2006 Lee
2006/0136096 A1 6/2006 Chiappetta
2006/0144834 A1 7/2006 Denney
2006/0178777 A1 8/2006 Park
2006/0190133 A1 8/2006 Konandreas
2006/0190134 A1 8/2006 Ziegler
2006/0190146 A1 8/2006 Morse
2006/0195015 A1 8/2006 Mullick
2006/0200281 A1 9/2006 Ziegler
2006/0213025 A1 9/2006 Sawalski
2006/0235570 A1 10/2006 Jung
2006/0235585 A1 10/2006 Tanaka
2006/0236492 A1* 10/2006 Sudo ..... A47L 11/24 15/319
2006/0288519 A1 12/2006 Jaworski
2006/0293788 A1 12/2006 Pogodin
2007/0016328 A1 1/2007 Ziegler
2007/0021867 A1 1/2007 Woo
2007/0059441 A1 3/2007 Greer
2007/0061040 A1 3/2007 Augenbraun et al.
2007/0114975 A1 5/2007 Cohen
2007/0118248 A1 5/2007 Lee et al.
2007/0124890 A1 6/2007 Erko
2007/0143950 A1 6/2007 Lin
2007/0156286 A1 7/2007 Yamauchi
2007/0179670 A1 8/2007 Chiappetta
2007/0189347 A1 8/2007 Denney
2007/0204426 A1 9/2007 Nakagawa
2007/0213892 A1 9/2007 Jones
2007/0214601 A1 9/2007 Chung
2007/0234492 A1 10/2007 Svendsen
2007/0244610 A1 10/2007 Ozick
2007/0266508 A1 11/2007 Jones
2007/0267230 A1 11/2007 Won
2007/0267570 A1 11/2007 Park
2007/0267998 A1 11/2007 Cohen
2007/0273864 A1 11/2007 Cho
2007/0276541 A1 11/2007 Sawasaki
2007/0285041 A1 12/2007 Jones
2007/0289267 A1 12/2007 Makarov
2007/0290649 A1 12/2007 Jones
2008/0000041 A1 1/2008 Jones
2008/0000042 A1 1/2008 Jones
2008/0001566 A1 1/2008 Jones
2008/0007193 A1 1/2008 Jones
2008/0007203 A1 1/2008 Cohen
2008/0009964 A1 1/2008 Bruemmer et al.
2008/0015738 A1 1/2008 Casey
2008/0016631 A1 1/2008 Casey
2008/0037170 A1 2/2008 Saliba
2008/0039974 A1 2/2008 Sandin
2008/0047092 A1 2/2008 Schnittman
2008/0051953 A1 2/2008 Jones
2008/0052846 A1 3/2008 Kapoor
2008/0058987 A1 3/2008 Ozick
2008/0063400 A1 3/2008 Hudson
2008/0065265 A1 3/2008 Ozick
2008/0077278 A1 3/2008 Park
2008/0084174 A1 4/2008 Jones
2008/0086241 A1 4/2008 Phillips
2008/0091304 A1 4/2008 Ozick
2008/0091305 A1 4/2008 Svendsen
2008/0093131 A1 4/2008 Couture
2008/0098553 A1 5/2008 Dayton
2008/0105445 A1 5/2008 Dayton
2008/0109126 A1 5/2008 Sandin
2008/0121097 A1 5/2008 Rudakevych
2008/0127445 A1 6/2008 Konandreas
2008/0127446 A1 6/2008 Ziegler
2008/0133052 A1 6/2008 Jones
2008/0134457 A1 6/2008 Morse
2008/0134458 A1 6/2008 Ziegler
2008/0140255 A1 6/2008 Ziegler
2008/0143063 A1 6/2008 Won
2008/0143064 A1 6/2008 Won
2008/0143065 A1 6/2008 DeFazio
2008/0152871 A1 6/2008 Greer
2008/0155768 A1 7/2008 Ziegler
2008/0179115 A1 7/2008 Ohm
2008/0183332 A1 7/2008 Ohm
2008/0184518 A1 8/2008 Taylor
2008/0196946 A1 8/2008 Filippov
2008/0205194 A1 8/2008 Chiappetta
2008/0209665 A1 9/2008 Mangiardi
2008/0221729 A1 9/2008 Lavarec
2008/0223630 A1 9/2008 Couture
2008/0235897 A1 10/2008 Kim
2008/0236907 A1 10/2008 Won
2008/0264456 A1 10/2008 Lynch
2008/0266254 A1 10/2008 Robbins
2008/0276407 A1 11/2008 Schnittman
2008/0276408 A1 11/2008 Gilbert
2008/0281470 A1 11/2008 Gilbert
2008/0282494 A1 11/2008 Won
2008/0294288 A1 11/2008 Yamauchi
2008/0307590 A1 12/2008 Jones
2009/0007366 A1 1/2009 Svendsen
2009/0025155 A1 1/2009 Nishiyama
2009/0030551 A1 1/2009 Hein et al.
2009/0037024 A1 2/2009 Jamieson
2009/0038089 A1 2/2009 Landry
2009/0044370 A1 2/2009 Won
2009/0045766 A1 2/2009 Casey
2009/0055022 A1 2/2009 Casey
2009/0065271 A1 3/2009 Won
2009/0070946 A1 3/2009 Tamada
2009/0078035 A1 3/2009 Mecca
2009/0107738 A1 4/2009 Won
2009/0125175 A1 5/2009 Park
2009/0126143 A1* 5/2009 Haegermarck ..... A47L 9/00 15/319
2009/0133720 A1 5/2009 Vandenbogert
2009/0145671 A1 6/2009 Filippov
2009/0173553 A1 7/2009 Won
2009/0180668 A1 7/2009 Jones
2009/0226113 A1 9/2009 Matsumoto
2009/0232506 A1 9/2009 Hudson
2009/0241826 A1 10/2009 Vosburgh
2009/0254217 A1 10/2009 Pack
2009/0254218 A1 10/2009 Sandin
2009/0265036 A1 10/2009 Jamieson
2009/0270015 A1 10/2009 DAmbra
2009/0274602 A1 11/2009 Alward
2009/0281661 A1 11/2009 Dooley et al.
2009/0292393 A1 11/2009 Casey
2009/0292884 A1 11/2009 Wang

(56) References Cited

U.S. PATENT DOCUMENTS

2009/0314318 A1 12/2009 Chang
2009/0314554 A1 12/2009 Couture
2009/0319083 A1 12/2009 Jones
2010/0001478 A1 1/2010 DeFazio
2010/0011529 A1 1/2010 Won
2010/0037418 A1 2/2010 Hussey
2010/0049364 A1 2/2010 Landry
2010/0049365 A1 2/2010 Jones
2010/0049391 A1 2/2010 Nakano
2010/0063628 A1 3/2010 Landry
2010/0075054 A1 3/2010 Kaneyama
2010/0076600 A1 3/2010 Cross
2010/0078415 A1 4/2010 Denney
2010/0082193 A1 4/2010 Chiappetta
2010/0107355 A1 5/2010 Won
2010/0108098 A1 5/2010 Splinter
2010/0115716 A1 5/2010 Landry
2010/0116566 A1 5/2010 Ohm
2010/0125968 A1 5/2010 Ho
2010/0139029 A1 6/2010 Kim
2010/0139995 A1 6/2010 Rudakevych
2010/0161225 A1 6/2010 Hyung et al.
2010/0173070 A1 7/2010 Niu
2010/0206336 A1 8/2010 Souid
2010/0217436 A1 8/2010 Jones
2010/0257690 A1 10/2010 Jones
2010/0257691 A1 10/2010 Jones
2010/0263142 A1 10/2010 Jones
2010/0263158 A1 10/2010 Jones
2010/0268384 A1 10/2010 Jones
2010/0275405 A1 11/2010 Morse
2010/0286791 A1 11/2010 Goldsmith
2010/0305752 A1 12/2010 Abramson
2010/0312429 A1 12/2010 Jones
2010/0313910 A1 12/2010 Lee
2010/0313912 A1 12/2010 Han
2011/0000363 A1 1/2011 More
2011/0004339 A1 1/2011 Ozick
2011/0010873 A1 1/2011 Kim
2011/0077802 A1 3/2011 Halloran
2011/0082668 A1 4/2011 Escrig
2011/0088609 A1 4/2011 Vosburgh
2011/0109549 A1 5/2011 Robbins
2011/0125323 A1 5/2011 Gutmann et al.
2011/0131741 A1 6/2011 Jones
2011/0154589 A1 6/2011 Reindle
2011/0202175 A1 8/2011 Romanov
2011/0209726 A1 9/2011 Dayton
2011/0252594 A1 10/2011 Blouin
2011/0258789 A1 10/2011 Lavabre
2011/0271469 A1 11/2011 Ziegler
2011/0277269 A1 11/2011 Kim
2011/0286886 A1 11/2011 Luchinger
2011/0288684 A1 11/2011 Farlow
2012/0011668 A1 1/2012 Schnittman
2012/0011669 A1 1/2012 Schnittman
2012/0011676 A1 1/2012 Jung
2012/0011677 A1 1/2012 Jung
2012/0011992 A1 1/2012 Rudakevych
2012/0036659 A1 2/2012 Ziegler
2012/0047676 A1 3/2012 Jung
2012/0049798 A1 3/2012 Cohen
2012/0079670 A1 4/2012 Yoon
2012/0083924 A1 4/2012 Jones
2012/0084934 A1 4/2012 Li
2012/0084937 A1 4/2012 Won
2012/0084938 A1 4/2012 Fu
2012/0085368 A1 4/2012 Landry
2012/0090133 A1 4/2012 Kim
2012/0095619 A1 4/2012 Pack
2012/0096656 A1 4/2012 Jung
2012/0097783 A1 4/2012 Pack
2012/0101661 A1 4/2012 Phillips
2012/0102670 A1 5/2012 Jang
2012/0109423 A1 5/2012 Pack
2012/0110755 A1 5/2012 Liu
2012/0118216 A1 5/2012 Vosburgh
2012/0125363 A1 5/2012 Kim
2012/0137464 A1 6/2012 Thatcher
2012/0137949 A1 6/2012 Vosburgh
2012/0151709 A1 6/2012 Tang
2012/0152280 A1 6/2012 Bosses
2012/0152877 A1 6/2012 Tadayon
2012/0159725 A1 6/2012 Kapoor
2012/0166024 A1 6/2012 Phillips
2012/0167917 A1 7/2012 Gilbert
2012/0169497 A1 7/2012 Schnittman
2012/0173018 A1 7/2012 Allen
2012/0173070 A1 7/2012 Schnittman
2012/0180254 A1 7/2012 Morse
2012/0180712 A1 7/2012 Vosburgh
2012/0181099 A1 7/2012 Moon
2012/0182392 A1 7/2012 Kearns
2012/0183382 A1 7/2012 Couture
2012/0185091 A1 7/2012 Field
2012/0185094 A1 7/2012 Rosenstein
2012/0185095 A1 7/2012 Rosenstein
2012/0185096 A1 7/2012 Rosenstein
2012/0192898 A1 8/2012 Lynch
2012/0194395 A1 8/2012 Williams
2012/0197439 A1 8/2012 Wang
2012/0197464 A1 8/2012 Wang
2012/0199006 A1 8/2012 Swett
2012/0199407 A1 8/2012 Morey
2012/0200149 A1 8/2012 Rudakevych
2012/0222224 A1 9/2012 Yoon
2012/0246862 A1 10/2012 Landry
2012/0260443 A1 10/2012 Lindgren
2012/0260861 A1 10/2012 Lindgren
2012/0261204 A1 10/2012 Won
2012/0265346 A1 10/2012 Gilbert
2012/0265391 A1 10/2012 Letsky
2012/0268587 A1 10/2012 Robbins
2012/0281829 A1 11/2012 Rudakevych
2012/0298029 A1 11/2012 Vosburgh
2012/0303160 A1 11/2012 Ziegler
2012/0311810 A1 12/2012 Gilbert
2012/0312221 A1 12/2012 Vosburgh
2012/0317745 A1 12/2012 Jung
2012/0322349 A1 12/2012 Josi
2013/0015596 A1 1/2013 Mozeika
2013/0025085 A1 1/2013 Kim
2013/0031734 A1 2/2013 Porat
2013/0032078 A1 2/2013 Yahnker
2013/0035793 A1 2/2013 Neumann
2013/0047368 A1 2/2013 Tran
2013/0054029 A1 2/2013 Huang
2013/0054129 A1 2/2013 Wong
2013/0060357 A1 3/2013 Li
2013/0060379 A1 3/2013 Choe
2013/0070563 A1 3/2013 Chiappetta
2013/0081218 A1 4/2013 Kim
2013/0085603 A1 4/2013 Chiappetta
2013/0086760 A1* 4/2013 Han ..... A47L 9/00
15/49.1
2013/0092190 A1 4/2013 Yoon
2013/0098402 A1 4/2013 Yoon et al.
2013/0103194 A1 4/2013 Jones
2013/0105233 A1 5/2013 Couture
2013/0117952 A1 5/2013 Schnittman
2013/0118524 A1 5/2013 Konandreas
2013/0138337 A1 5/2013 Pack
2013/0145572 A1 6/2013 Schregardus
2013/0152724 A1 6/2013 Mozeika
2013/0160226 A1 6/2013 Lee
2013/0166107 A1 6/2013 Robbins
2013/0174371 A1 7/2013 Jones
2013/0204463 A1 8/2013 Chiappetta
2013/0204465 A1 8/2013 Phillips
2013/0204483 A1 8/2013 Sung
2013/0205520 A1 8/2013 Kapoor
2013/0206170 A1 8/2013 Svendsen
2013/0206177 A1 8/2013 Burlutskiy
2013/0211589 A1 8/2013 Landry

(56) References Cited

U.S. PATENT DOCUMENTS

| | | | |
|---|---|---|---|
| 2013/0214498 | A1 | 8/2013 | DeFazio |
| 2013/0226344 | A1 | 8/2013 | Wong |
| 2013/0227801 | A1 | 9/2013 | Kim |
| 2013/0227812 | A1 | 9/2013 | Kim |
| 2013/0228198 | A1 | 9/2013 | Hung |
| 2013/0228199 | A1 | 9/2013 | Hung |
| 2013/0231779 | A1 | 9/2013 | Purkayastha |
| 2013/0231819 | A1 | 9/2013 | Hung |
| 2013/0232702 | A1 | 9/2013 | Baek |
| 2013/0239870 | A1 | 9/2013 | Hudson |
| 2013/0241217 | A1 | 9/2013 | Hickey |
| 2013/0253701 | A1 | 9/2013 | Halloran |
| 2013/0256042 | A1 | 10/2013 | Rudakevych |
| 2013/0268118 | A1 | 10/2013 | Grinstead |
| 2013/0269148 | A1 | 10/2013 | Chiu |
| 2013/0273252 | A1 | 10/2013 | Miyamoto |
| 2013/0298350 | A1 | 11/2013 | Schnittman |
| 2013/0310978 | A1 | 11/2013 | Ozick |
| 2013/0325178 | A1 | 12/2013 | Jones |
| 2013/0331987 | A1 | 12/2013 | Karlsson |
| 2013/0338525 | A1 | 12/2013 | Allen |
| 2013/0338828 | A1 | 12/2013 | Chiappetta |
| 2013/0338831 | A1 | 12/2013 | Noh |
| 2013/0340201 | A1 | 12/2013 | Jang et al. |
| 2014/0016469 | A1 | 1/2014 | Ho |
| 2014/0026339 | A1 | 1/2014 | Konandreas |
| 2014/0053351 | A1 | 2/2014 | Kapoor |
| 2014/0109339 | A1 | 4/2014 | Won |
| 2014/0123325 | A1 | 5/2014 | Jung |
| 2014/0130272 | A1 | 5/2014 | Won |
| 2014/0142757 | A1 | 5/2014 | Ziegler |
| 2014/0167931 | A1 | 6/2014 | Lee |
| 2014/0180968 | A1 | 6/2014 | Song |
| 2014/0207280 | A1 | 7/2014 | Duffley |
| 2014/0207281 | A1 | 7/2014 | Angle |
| 2014/0207282 | A1 | 7/2014 | Angle |
| 2014/0238440 | A1 | 8/2014 | Dayton |
| 2014/0249671 | A1 | 9/2014 | Halloran |
| 2014/0283326 | A1 | 9/2014 | Song |
| 2015/0005937 | A1 | 1/2015 | Ponulak |
| 2015/0032259 | A1 | 1/2015 | Kim |
| 2015/0039127 | A1 | 2/2015 | Matsumoto |
| 2015/0057800 | A1 | 2/2015 | Cohen |
| 2015/0120056 | A1 | 4/2015 | Noh et al. |
| 2015/0197012 | A1 | 7/2015 | Schnittman |
| 2015/0206015 | A1 | 7/2015 | Ramalingam |
| 2015/0265122 | A1 | 9/2015 | Han et al. |
| 2016/0306359 | A1 | 10/2016 | Lindhe |
| 2016/0316982 | A1 | 11/2016 | Kim et al. |
| 2017/0273521 | A1 | 9/2017 | Klintemyr et al. |
| 2017/0273524 | A1 | 9/2017 | Klintemyr et al. |
| 2018/0103812 | A1 | 4/2018 | Lee et al. |

FOREIGN PATENT DOCUMENTS

| | | | | |
|---|---|---|---|---|
| CN | 1668238 | A | 9/2005 | |
| CN | 101161174 | A | 4/2008 | |
| CN | 101297267 | A | 10/2008 | |
| CN | 102083352 | A | 6/2011 | |
| CN | 103027634 | | 4/2013 | |
| CN | 103054516 | A | 4/2013 | |
| CN | 103491838 | A | 1/2014 | |
| CN | 103565373 | A | 2/2014 | |
| DE | 3536907 | | 4/1986 | |
| DE | 9307500 | | 7/1993 | |
| DE | 4211789 | | 10/1993 | |
| DE | 4340367 | | 6/1995 | |
| DE | 4439427 | A1 | 5/1996 | |
| DE | 19849978 | | 5/2000 | |
| DE | 102010000174 | | 7/2011 | |
| DE | 102010000573 | | 9/2011 | |
| DE | 102010037672 | | 3/2012 | |
| EP | 2438843 | | 4/1920 | |
| EP | 0142594 | | 5/1985 | |
| EP | 0358628 | | 3/1990 | |
| EP | 0474542 | | 3/1992 | |
| EP | 0569984 | | 11/1993 | |
| EP | 0606173 | | 7/1994 | |
| EP | 1099143 | | 11/2003 | |
| EP | 1360922 | A2 | 11/2003 | |
| EP | 1441271 | | 7/2004 | |
| EP | 1331537 | | 8/2005 | |
| EP | 2050380 | | 4/2009 | |
| EP | 1969438 | | 9/2009 | |
| EP | 1395888 | | 5/2011 | |
| EP | 2316322 | | 5/2011 | |
| EP | 2296005 | | 6/2011 | |
| EP | 2251757 | | 11/2011 | |
| EP | 2417894 | | 2/2012 | |
| EP | 2466411 | A2 | 6/2012 | |
| EP | 2561787 | | 2/2013 | |
| EP | 2578125 | | 4/2013 | |
| EP | 2583609 | | 4/2013 | |
| EP | 2604163 | | 6/2013 | |
| EP | 2447800 | | 4/2014 | |
| EP | 2741483 | | 6/2014 | |
| EP | 2772815 | | 9/2014 | |
| EP | 2884364 | A1 | 6/2015 | |
| FR | 2999410 | | 6/2014 | |
| GB | 1447943 | | 9/1976 | |
| GB | 2355523 | | 4/2001 | |
| GB | 2382251 | | 5/2003 | |
| GB | 2494446 | | 3/2013 | |
| JP | 5540959 | | 3/1980 | |
| JP | S62292126 | * | 12/1986 | ..... A47L 5/12 |
| JP | 6286414 | | 4/1987 | |
| JP | 62109528 | | 5/1987 | |
| JP | 62120510 | | 6/1987 | |
| JP | 63127310 | A | 5/1988 | |
| JP | 63181727 | | 7/1988 | |
| JP | 63241610 | | 10/1988 | |
| JP | 03162814 | A | 7/1991 | |
| JP | 03166074 | | 7/1991 | |
| JP | 04260905 | | 9/1992 | |
| JP | 0584200 | | 4/1993 | |
| JP | 0584210 | | 4/1993 | |
| JP | 05084200 | | 4/1993 | |
| JP | 05189041 | | 7/1993 | |
| JP | 05224745 | | 9/1993 | |
| JP | 05228090 | | 9/1993 | |
| JP | 064133 | | 1/1994 | |
| JP | 0683442 | A | 3/1994 | |
| JP | 06125861 | | 5/1994 | |
| JP | 06144215 | | 5/1994 | |
| JP | 06179145 | | 6/1994 | |
| JP | 075922 | | 1/1995 | |
| JP | 0759695 | | 3/1995 | |
| JP | 0732752 | B2 | 4/1995 | |
| JP | 07129239 | A | 5/1995 | |
| JP | 07281742 | | 10/1995 | |
| JP | 08089455 | | 4/1996 | |
| JP | 08326025 | | 12/1996 | |
| JP | 0944240 | | 2/1997 | |
| JP | 09150741 | | 6/1997 | |
| JP | 09185410 | | 7/1997 | |
| JP | 11267074 | | 10/1999 | |
| JP | 2001022443 | | 1/2001 | |
| JP | 2001167009 | | 7/2001 | |
| JP | 2002182742 | A | 6/2002 | |
| JP | 2002287824 | A | 10/2002 | |
| JP | 2002355204 | | 12/2002 | |
| JP | 2002366228 | | 12/2002 | |
| JP | 2003280740 | | 10/2003 | |
| JP | 2004096253 | | 3/2004 | |
| JP | 2004166968 | | 6/2004 | |
| JP | 2004198212 | | 7/2004 | |
| JP | 2004303134 | A | 10/2004 | |
| JP | 2005040597 | A | 2/2005 | |
| JP | 2005124753 | A | 5/2005 | |
| JP | 2005141636 | A | 6/2005 | |
| JP | 2005314116 | A | 11/2005 | |
| JP | 2006015113 | A | 1/2006 | |
| JP | 2006087507 | | 4/2006 | |
| JP | 2006185438 | A | 7/2006 | |

(56) References Cited

FOREIGN PATENT DOCUMENTS

| | | | |
|---|---|---|---|
| JP | 2006231477 | | 9/2006 |
| JP | 2006314669 | | 11/2006 |
| JP | 2007014369 | A | 1/2007 |
| JP | 2007070658 | | 3/2007 |
| JP | 2007143645 | A | 6/2007 |
| JP | 2007213236 | A | 8/2007 |
| JP | 2007226322 | A | 9/2007 |
| JP | 2007272665 | A | 10/2007 |
| JP | 2008132299 | A | 6/2008 |
| JP | 2008146617 | A | 6/2008 |
| JP | 2008290184 | | 12/2008 |
| JP | 2008543394 | A | 12/2008 |
| JP | 2009500741 | A | 1/2009 |
| JP | 2009509220 | | 3/2009 |
| JP | 2009193240 | A | 8/2009 |
| JP | 2010507169 | A | 3/2010 |
| JP | 2010079869 | A | 4/2010 |
| JP | 2010526594 | | 8/2010 |
| JP | 2010534825 | A | 11/2010 |
| JP | 2011045694 | | 3/2011 |
| JP | 2011253361 | A | 12/2011 |
| JP | 2012216051 | A | 11/2012 |
| JP | 2013041506 | A | 2/2013 |
| JP | 2013089256 | A | 5/2013 |
| JP | 2013247986 | A | 12/2013 |
| JP | 2014023930 | A | 2/2014 |
| KR | 20040096253 | | 11/2004 |
| KR | 20050003112 | | 1/2005 |
| KR | 20070070658 | | 7/2007 |
| KR | 20090028359 | | 3/2009 |
| KR | 101231932 | | 3/2013 |
| NL | 7408667 | | 1/1975 |
| WO | 8804081 | | 6/1988 |
| WO | 9303399 | | 7/1988 |
| WO | 9638770 | | 12/1996 |
| WO | 0036961 | | 6/2000 |
| WO | 0036970 | | 6/2000 |
| WO | 0038025 | | 6/2000 |
| WO | 0182766 | A2 | 11/2001 |
| WO | 03022120 | | 3/2003 |
| WO | 03024292 | | 3/2003 |
| WO | 03026474 | | 4/2003 |
| WO | 2004006034 | A2 | 1/2004 |
| WO | 2004082899 | | 9/2004 |
| WO | 2007008148 | | 1/2007 |
| WO | 2007028049 | | 3/2007 |
| WO | 2007051972 | | 5/2007 |
| WO | 2007065034 | | 6/2007 |
| WO | 2008048260 | | 4/2008 |
| WO | 2009132317 | | 10/2009 |
| WO | 2013105431 | | 7/2013 |
| WO | 2013157324 | | 10/2013 |
| WO | 2014033055 | | 3/2014 |
| WO | 2015016580 | | 2/2015 |

OTHER PUBLICATIONS

Chinese Office Action for Chinese Application No. 201380075503.9, dated Feb. 13, 2017 with translation, 18 pages.

Chung etal.,"Path Planning for a Mobile Robot With Grid Type World Model", Proceedings of the 1992 IEEE/RSJ International Conference on Intelligent Robots and Systems,Jul. 7-10, 1992, pp. 439-444.

Extended European Search Report for European Application No. 16176479.0, dated Nov. 11, 2016, 9pages.

Final Office Action for U.S. Appl. No. 14/409,291, dated Jun. 6, 2017, 21 pages.

Final Office Action for U.S. Appl. No. 15/100,667, dated Apr. 21, 2017, 26 pages.

International Search Report and Written Opinion of the International Searching Authority fo rInternatonal Applicaion No. PCT/EP2014/0077142, dated Sep. 11, 2015, 8 pages.

International Search Report and Written Opinion of the International Searching Authority for *International Application No. PCT/EP2015/058377, dated Aug. 10, 2016, 15 pages.

International Search Report and Written Opinion of the International Searching Authority for International Application No. PCT/EP2014/069073, dated May 12, 2015, 10pages.

International Search Report and Written Opinion of the International Searching Authority for International Application No. PCT/EP2014/069074, dated May 11, 2015, 9 pages.

International Search Report and Written Opinion of the International Searching Authority for International Application No. PCT/EP2014/077549, dated Jul. 27, 2015, 9 pages.

International Search Report and Written Opinion of the International Searching Authority for International Application No. PCT/EP2014/077947, dated Jul. 11, 2016, 14 pages.

International Search Report and Written Opinion of the International Searching Authority for International Application No. PCT/EP2014/077954, dated Oct. 12, 2015, 19pages.

International Search Report and Written Opinion of the International Searching Authority for International Application No. PCT/EP2014/078144, 7 pages.

Japanese Office Action for Application for Japanese Application No. 2015-528969, dated Apr. 7, 2017 with translation, 4 pages.

Japanese Office Action for Japanese Application No. 2016-506794, dated Feb. 7, 2017 with translation, 10 pages.

Japanese Office Action for Japanese Application No. 2016-506795 , dated Feb. 7, 2017 with translation, 6 pages.

Non Final Office Action for U.S. Appl. No. 14/409,291, dated Dec. 28, 2016, 61pages.

Non Final Office Action for U.S. Appl. No. 15/100,667, dated Sep. 12, 2016, 24 pages.

Non Final Office Action for U.S. Appl. No. 15/101,212, dated May 17, 2017, 8 pages.

Non Final Office Action for U.S. Appl. No. 15/101,235 dated Apr. 21, 2017, 10 pages.

Non Final Office Action for U.S. Appl. No. 15/101,257, dated Feb. 10, 2017, 10 pages.

Non Final Office Action for U.S. Appl. No. 15/102,015, dated Aug. 17, 2017, 13 pages.

Notice of Allowance for U.S. Appl. No. 15/101,257, dated Jul. 6, 2017, 9 pages.

Notice of Allowance for U.S. Appl. No. 14/409,291, dated Sep. 18, 2017, 8 pages.

Notice of Reasons for Rejection for Japanese Application No. 2016-526764, dated Aug. 25, 2017 with translation, 6 pages.

Notification fo Reasons for Rejection for Japanese Application No. 2016-526765, dated Aug. 25, 2017 with translation, 7 pages.

Notification of Reasons for Refusal for Japanese Application No. 2016-526759, dated Aug. 24, 2017 with translation, 9 pages.

Notifcation of Reasons for Refusal for Japanese Application No. 2016-526756, dated Aug. 10, 2017 with translation, 6 pages.

International Search Report for International Application No. PCT/EP2013/057814 dated Dec. 20, 2013.

International Search Report for International Application No. PCT/EP2013/057815 dated Apr. 2, 2014.

International Search Report for International Application No. PCT/EP2013/067500 dated Dec. 10, 2013.

Notice of Allowance for U.S. Appl. No. 14/409,291, dated Jun. 16, 2016, 13 pages.

Written Opinion for International Application No. PCT/EP2013/067500 dated Dec. 10, 2013.

"SM51 Series Opposed Mode Sensors, DC sensors with metal housings: SM51EB/RB, SM51EB6/RB6", Banner Engineering Corporation, pp. 1-24.

Andersson, et al., "ISR: An Intelligent Service Robot", Centre for Autonomous Systems, Royal Institute of Technology, S-100 44 Stockholm, Sweden, pp. 1-24.

Berlin, et al. "Development of a Multipurpose Mobile Robot for Concrete Surface Processing", A Status Report, Feb. 1992, Sweden, pp. 1-10.

Borenstein, et al. "Real-Time Obstacle Avoidances for Fast Mobile Robots", IEEE, Jan. 6, 1996, pp. 1-18.

(56) References Cited

OTHER PUBLICATIONS

Braunstingi, et al., "Fuzzy Logic Wall Following of a Mobile Robot Based on the Concept of General Perception", ICAR '95, 7th International Conference on Advanced Robotics, Sant Feliu De Guixols, Spain pp. 367-376., Sep. 1995, pp. 1-9.
Caselli, et al. "Mobile Robot Navigation in Enclosed Large-Scale Space", Italy and U.S..A., pp. 1-5.
Cassens, et al. "Finishing and Maintaining Wood Floors", Wood Finishing., North Central Regional Extension Publication #136, pp. 1-8.
Collins, et al. "Cerebellar Control of a Line Following Robot", Computer Science and Electrical Engineering Department, University of Queensland, St.Lucia, Queensland, 4072 A, pp. 1-6.
Doty, et al. "Sweep Strategies for a Sensory-Driven, Behavior-Based Vacuum Cleaning Agent", 1993, Machine Intelligence Laboratory-Gainesville Florida, AAAI 1993 Fall Symposium Series-Research Triangle Park—Raleigh, NC, Oct. 22-24, 1993, pp. 1-6.
Everett, Sensors for Mobile Robots Theory and Application, A.K. Peters, 1995, Chapters 1 and 3.
Everett, Sensors for Mobile Robots Theory and Application, A.K. Peters, Ltd., 1995, Chapters, 4 and 5.
Everett, Sensors for Mobile Robots Theory and Application, A.K. Peters, Ltd., 1995, Chapters 6, 7 and 10.
Everett, Sensors for Mobile Robots Theory and Application, A.K. Peters, Ltd.,1995, Chapters 15 and 16.
Everett, et al. "Survey of Collision Avoidance and Ranging Sensors for Mobile Robots", Revision 1, Technical Report 1194, Dec. 1992, pp. 1-154.
Gavrilut, et al., "Wall-Following Method for an Autonomous Mobile Robot using Two IR Sensors", 12th WSEAS International Conference on Systems, Heraklion, Greece, Jul. 22-24, 2008, ISBN: 978-960-6766-83-1, ISSN: 1790-2769, pp. 205-209.
Herbst, et al., "Micromouse Design Specifications", Jun. 2, 1998, pp. 1-22.
International Preliminary Report on Patentability for International Application No. PCT/EP2013/077377, dated Jun. 21, 2016, 12 pages.
International Premilinary Report on Patentability for International Application No. PCT/EP2013/077378, dated Jun. 21, 2016, 7 pages.
International Preliminary Report on Patentability for International Application No. PCT/EP2013/077384, dated Jun. 21, 2016, 6 pages.
International Preliminary Report on Patentability for International Application No. PCT/EP2013/077385, dated Jun. 21, 2017, 7 pages.
International Preliminary Report on Patentability for International Application No. PCT/EP2013/077386, dated Jun. 21, 2016, 6 pages.
International Preliminary Report on Patentability for International Application No. PCT/EP2013/077387, dated Jun. 21, 2016, 9 pages.
International Preliminary Report on Patentability for International Application No. PCT/EP2013/077657, dated Jun. 21, 2016, 7 pages.
International Preliminary Report on Patentability for International Application No. PCT/EP203/077661, dated Jun. 21, 2016, 11 pages.
International Preliminary Report on Patentability for International Application No. PCT/EP203/077380, dated Jun. 21, 2016, 6 pages.
International Search Report and Written Opinion of the International Searching Authority for International Application No. PCT/Ep2012/077377, dated Nov. 6, 2014, 18 pages.
International Search Report and Written Opinion of the International Searching Authority for International Application No. PCT/EP2013/077378, dated Apr. 9, 2014, 9 pages.
International Search Report and Written Opinion of the International Searching Authority for International Application No. PCT/EP2013/077380, dated Jul. 28, 2014, 8 pages.
International Search Report and Written Opinion of the International Searching Authority for International Application No. PCT/EP2013/077384, dated Aug. 14, 2016, 9 pages.
International Search Report and Written Opinion of the International Searching Authority for International Application No. PCT/EP2013/077385, dated May 27, 2015, 9 pages.
International Search Report and Written Opinion of the International Searching Authority for International Application No. PCT/EP2013/077386, dated Sep. 17, 2014, 9 pages.
International Search Report and Written Opinion of the International Searching Authority for International Application No. PCT/EP2013/077387, dated Sep. 30, 2014, 12 pages.
International Search Report and Written Opinion of the International Searching Authority for International Application No. PCT/EP2013/077661, dated Jun. 10, 2014, 15 pages.
International Search Report and Written Opinion of the International Searching Authority for International Application No. PCT/EP32013/077657, dated Aug. 18, 2014, 10 pages.
Jenkins, "Practical Requirements for a Domestic Vacuum-Cleaning Robot", From: AAAI Technical Report FS-93-03., JRL Consulting, Menlo Park, California, pp. 85-90.
Jones et al., Mobile Robots Inspiration to Implementation, Second Edition, A.K. Peters, Ltd., 1999, Chapters 6 and 9.
Jones et al., Mobile Robots Inspiration to Implementation, Second Edition, A.K. Peters, Ltd., 1999, Chapters 1 and 5.
Jones et al., Mobile Robots Inspiration to Implementation, Second Edition, A.K. Peters, Ltd., 1999, Chapters 10 and 11.
Jung, et al. "Whisker Based Mobile Robot Navigation", Wollongong, NSW 2500, Australia, pp. 1-8.
Krishna, et al., "Solving the Local Minima Problem for a Mobile Robot by Classification of Spatio-Temporal Sensory Sequences", Journal of Robotic Systems 17 (10), 2000, pp. 549-564.
Kube, "A Minimal Infrared Obstacle Detection Scheme", Department of Computing Science, University of Alberta, Edmonton, Alberta, Canada, The Robotics Practitioner, 2(2): 15-20, 1996, Oct. 23, 1998, pp. 1-8.
Larson, "RoboKent—a case study in man-machine interfaces" Industrial Robot, vol. 25 No. 2, 1998, pp. 95-100.
LeBouthillier, "W. Grey Walter and his Turtle Robots", The Robot Builder, Volume Eleven Number Five, May 1999, RSSC POB 26044, Santa Ana,CA, pp. 1-8.
Maaref, et al. "Sensor-based navigation of a mobile robot in an indoor enviornment", Robotics and Autonomous Systems, 2002, Elsevier.
Oren, Reply to Office Action dated Jun. 23, 2014, U.S. Appl. No. 13/757,985, pp. 1-10.
Pack, et al,. "Constructing a Wall-Follower Robot for a Senior Design Project", 1996 ASEE Annual Conference Proceedings, Session 1532, pp. 1-7.
Saffiotti, "Fuzzy logic in Autonomous Robot Navigation", a case study, Nov. 1995 Revised: Aug. 1997, IRIDIA, Universite Libre de Bruxelles, Belgium, , Technical Report TR/IRIDIA/ 95 25, Cover page + pp. 1-14.
Yamamoto, "SOZZY: A Hormone-Driven Autonomous Vacuum Cleaner", From: AAAI Technical Report FS-93-03, Matasushita Research Institute, Tokyo, and MIT Artificial Intelligence laboratory, Massachusetts, pp. 116-124 + Figure 9 and Figure 11.
Michael Carsten Bosse, "Atlas: A Framework for Large Scale Automated Mapping and Localization", Massachusetts Institute of Technology, Feb. 2004, Part 1, 140 pages.
Michael Carsten Bosse, "Atlas: A Framework for Large Scale Automated Mapping and Localization", Massachusetts Institute of Technology, Feb. 2004, Part 2, 67 pages.
Non Final Office Action for U.S. Appl. No. 15/102,017, dated Feb. 16, 2018, 12 pages.
European Communication Pursuant to Article 94(3) for European Application No. 13817911.4, dated Jan. 15, 2018, 8 pages.
Chinese Office Action for Chinese Application No. 201380075503.9, dated Nov. 8, 2017 with translation, 16 pages.
European Communication Pursuant to Article 94(3) for European Application No. 16176479.0, dated Nov. 27, 2017, 6 pages.
Chinese Office Action for Chinese Application No. 201380075510.9, dated Oct. 27, 2017 with translation, 13 pages.
Notification of Reasons for Refusal for Japanese Application No. 2016-526945, dated Oct. 31, 2017 with translation, 8 pages.
Notification of Reasons for Refusal for Japanese Application No. 2016-526875, dated Oct. 31, 2017 with translation, 10 pages.
Notification of Reasons for Rejection for Japanese Application No. 2016-526947, dated Sep. 21, 2017 with translation, 8 pages.

(56) References Cited

OTHER PUBLICATIONS

Non Final Office Action for U.S. Appl. No. 15/101,235, dated Nov. 1, 2017, 11 pages.
Non Final Office Action for U.S. Appl. No. 15/100,667, dated Nov. 29, 2017, 22 pages.
Final Office Action for U.S. Appl. No. 15/101,212, dated Oct. 11, 2017, 7 pages.
Notice of Allowance for U.S. Appl. No. 15/102,015, dated Dec. 11, 2017, 8 pages.
International Search Report and Written Opinion for International Application No. PCT/EP2015/070140, dated May 27, 2016, 11 pages.
Non Final Office Action for U.S. Appl. No. 15/101,515, dated Apr. 18, 2018, 14 pages.
Notice of Allowance for U.S. Appl. No. 15/101,212, dated Apr. 11, 2018, 9 pages.
Final Office Action for U.S. Appl. No. 15/100,667, dated Mar. 27, 2018, 23 pages.
Notification of Reasons for Refusal for Japanese Application No. 2017-501374, dated Mar. 6, 2018 with translation, 8 pages.
Chinese Office Action for Chinese Application No. 201380081535.X, dated Mar. 26, 2018 with translation, 18 pages.
Chinese Office Action for Chinese Application No. 201380081103.9, dated Feb. 27, 2018 with translation, 19 pages.
Final Office Action for U.S. Appl. No. 15/102,107, dated Jun. 14, 2018, 12 pages.
Non Final Office Action for U.S. Appl. No. 15/101,235, dated Jun. 14, 2018, 11 pages.
Chinese Office Action for Chinese Application No. 201380081331.6, dated Mar. 26, 2018 with translation, 27 pages.
Decision of Refusal for Japanese Application No. 2016-526945, dated May 15, 2018 with translation, 5 pages.
Decision of Refusal for Japanese Application No. 2016-526875, dated May 15, 2018 with translation, 6 pages.
Notification of Reasons for Refusal for Japanese Application No. 2016-526765, dated May 15, 2018 with translation, 6 pages.
International Search Report and Written Opinion for International Application No. PCT/EP2016/055547, dated Jan. 2, 2017, 10 pages.
Notice of Allowance for U.S. Appl. No. 15/100,667, dated Aug. 6, 2018, 10 pages.
Non Final Office Action for U.S. Appl. No. 15/101,510, dated Jul. 27, 2018, 17 pages.
Non Final Office Action for U.S. Appl. No. 14/784,110, dated Aug. 16, 2018, 13 pages.
Chinese Office Action for Chinese Application No. 201380081537.9, dated Jun. 4, 2018 with translation, 15 pages.
Notice of Allowance for U.S. Appl. No. 15/102,295, dated Sep. 24, 2018, 9 pages.
Notice of Allowance for U.S. Appl. No. 15/101,515, dated Aug. 28, 2018, 11 pages.
Non Final Office Action for U.S. Appl. No. 15/321,333, dated Oct. 24, 2018, 10 pages.
Position_Definition of Position by Merriam-Webster.pdf (Position | Definition of Position by Merriam-Webster, Oct. 16, 2018, Merriam-Webster, https://www.merriam-webster.com/dictionary/position, pages 1-15.
Gutman et al., AMOS: Comparison of Scan Matching Approaches for Self-Localization in Indoor Environments, 1996, IEEE, pp. 61-67.
Non Final Office Action for U.S. Appl. No. 15/504,071, dated Nov. 2, 2018, 17 pages.
Non Final Office Action for U.S. Appl. No. 15/504,066, dated Nov. 5, 2018, 18 pages.
Notification of Reasons for Refusal of Japanese Application No. 2016-568949, dated Oct. 9, 2018 with translation, 6 pages.
Exended European Search Report for European Application No. 18157403.9, dated Nov. 14, 2018, 12 pages.
Report of Reconsideration by Examiner before Appeal for Japanese Application No. 2016-526875, dated Oct. 24, 2018, 2 pages.
Office Action for U.S. Appl. 15/101,235, dated Jan. 11, 2018, 12 pages.

* cited by examiner

ROBOTIC VACUUM CLEANER WITH PROTRUDING SIDEBRUSH

This application is a U.S. National Phase application of PCT International Application No. PCT/EP2013/057815, filed Apr. 15, 2013, which is incorporated by reference herein.

TECHNICAL FIELD

The invention relates to a robotic vacuum cleaner.

BACKGROUND

Robotic vacuum cleaners are know in the art, which are equipped with drive means in the form of a motor for moving the cleaner across a surface to be cleaned. The robotic vacuum cleaners are further equipped with intelligence in the form of microprocessor(s) and navigation means for causing an autonomous behaviour such that the robotic vacuum cleaners freely can move around and clean a space in the form of e.g. a room.

Traditionally, robotic vacuum cleaners have been arranged with circular-shaped main bodies. Such a robot having co-axial drive wheels at the centre of its body has the advantage that it is easy to control and cannot get stuck since it always can rotate 180° and go back the same way it came. However, the circular-shaped main body makes them unsuitable for cleaning corners or edges where a floor meets a wall since these circular vacuum cleaners due to their shape cannot move into a corner or close enough to a wall, or other objects around which cleaning is required such as e.g. chair legs. An example of a robotic vacuum cleaner aiming at solving this problem is disclosed in WO 03/024292, the main body of which at its rear end is circular-shaped, whereas the front end of the main body is substantially rectangular. This is an improvement over the traditional circular-shaped robotic vacuum cleaners in terms of reaching into corners. Further, sweeping brushes are arranged at a bottom side of the main body and disposed such that they are associated with front corner regions of the rectangular-shaped main body front end. However, the robotic vacuum cleaner disclosed in WO 03/024292 still has problems reaching into corners

SUMMARY

An object of the present invention is to solve or at least mitigate a problem of how to provide a robotic vacuum cleaner for navigating corners and turning around in narrow spaces.

This object is attained by a robotic cleaning device comprising a main body, at least one driving wheel arranged to move the robotic cleaning device across a surface to be cleaned, and driving means arranged to control the at least one driving wheel to rotate in order to move the robotic cleaning device across the surface to be cleaned. Further, the robotic cleaning device comprises control means arranged to control the driving means to move the robotic cleaning device across the surface to be cleaned in accordance with navigation information and a cleaning member arranged at a bottom side of the main body for removing debris from the surface to be cleaned, the cleaning member being arranged in a front end portion of the main body, wherein the main body is arranged at the front end portion with a horizontally protruding member on which a brush is arranged.

Advantageously, by providing the main body of the robotic vacuum cleaner with the horizontally protruding member and the brush, the robotic cleaning device is capable of reaching into and cleaning corners and other areas where prior art robotic vacuum cleaners cannot reach. Advantageously, the brush which preferably rotates is guided by the protruding member into a corner and moves the debris located out of reach of the cleaning member of the robotic cleaning device such that the debris ends up under the main body and thus can be transported to a dust bag of the robotic vacuum cleaner 10 via the cleaning member 15. Thus, debris and dust located at the very walls and corners can be removed by the robotic cleaning device.

In an embodiment of the present invention, the main body has a front end portion with a front end wall, a rear end portion, a right side wall connecting the front end wall and the rear end portion and a left side wall connecting the front end wall and the rear end portion. The main body thus have a three-lobed shape in this particular embodiment, which is advantageous for moving in and out of corners and navigating narrow spaces like for instance corridors.

In a further embodiment of the present invention, the main body is further arranged such that its width is greatest between an outermost point of the horizontally protruding member and the oppositely located side wall, which greatest width is located at the front end portion of the main body. Since the width of the main body is at its greatest in a lateral direction between the right side wall and the left side wall at the front end portion of the main body, the robotic cleaning device according to embodiments of the present invention can move into a corner and turn the corner to move along an intersecting wall without bumping its rear end portion into the wall leading into the corner. In an embodiment of the present invention, the side walls of the main body are curved. Advantageously, they will thus track the wall leading into the corner when the robotic cleaning device turns the corner and pursues the wall leading out of the corner.

In still another embodiment of the present invention, the cleaning member is arranged adjacent to the front end wall and extending laterally in an opening in the main body along a greater part of the front end wall. Thereby, the robotic cleaning device advantageously cleans an area as wide as possible which contributes to reducing time (and energy consumption) needed to clean a surface.

In yet another embodiment of the present invention, the robotic cleaning device further comprises obstacle detecting means arranged to detect obstacles and provide the control means with the navigation information for enabling navigation of the robotic cleaning device.

In a further embodiment of the present invention, the robotic cleaning device further comprises a flexible bumper enclosing at least the front end portion of the main body. Advantageously, as long as the robotic cleaning device moves forward, the only part of the main body that can run into obstacles is the bumper, implying that collisions with all obstacles can be detected by the bumper. The shape of the main body of the robotic cleaning device as proposed in embodiments of the present invention in combination with appropriate control of the movement of the cleaning device ensures that the robot can maneuver out of all situations when the bumper has detected an obstacle, just like prior art robotic vacuum cleaners having circular-shaped main bodies, and—in contrast to prior art circular-shaped robot cleaners—that corners further can be effectively cleaned.

Further, since the bumper is flexible, it will press resiliently against the front end wall when contacting obstacles, thus mitigating the thrusting effect it has on obstacles in its way and reducing the risk that the obstacles will be displaced, tipped over and/or be damaged.

Thus, the obstacle detecting means may comprises the flexible bumper and at least one sensor with which the flexible bumper is arranged to cooperate in order to register the robotic cleaning device contacting an obstacle, which sensor is arranged to communicate the navigation information to the control means.

In a further embodiment, an indentation is arranged in the front end portion of the main body adjacent to a respective one of the one or more protruding member(s) and associated brush(es). This is advantageous since the brush can reach around the periphery of smaller obstacles, such as chair legs. By having the indentation enclosing, or at least partly enclosing, the periphery of the smaller obstacles, the area around the obstacles can be more effectively cleaned.

It is noted that the invention relates to all possible combinations of features recited in the claims. Further features of, and advantages with, the present invention will become apparent when studying the appended claims and the following description. Those skilled in the art realize that different features of the present invention can be combined to create embodiments other than those described in the following.

BRIEF DESCRIPTION OF THE DRAWINGS

The invention is now described, by way of example, with reference to the accompanying drawings, in which.

DETAILED DESCRIPTION

Figure 1A:
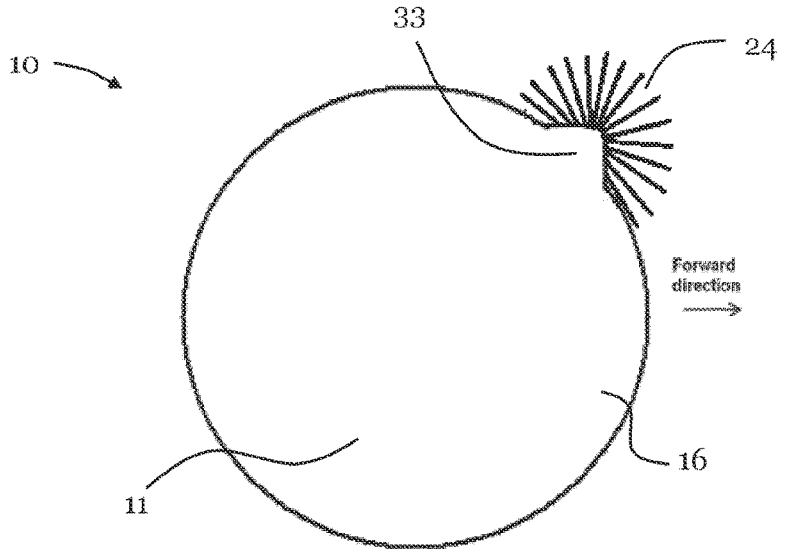
FIG. 1*a* shows a robotic cleaning device according to an embodiment of the present invention in a top view.

The invention will now be described more fully hereinafter with reference to the accompanying drawings, in which certain embodiments of the invention are shown. This invention may, however, be embodied in many different forms and should not be construed as limited to the embodiments set forth herein; rather, these embodiments are provided by way of example so that this disclosure will be thorough and complete, and will fully convey the scope of the invention to those skilled in the art. All figures except FIG. 1*a* shows the robotic cleaning device from a bottom perspective. Directional information, such as e.g. "a right side wall" of the cleaning device should be construed as meaning the side wall on the right hand side of the main body from a top perspective of the cleaning device when viewed from its rear end portion.

The invention relates to robotic cleaning devices, or in other words, to automatic, self-propelled machines for cleaning a surface. The robotic cleaning device according to the invention can be mains-operated and have a cord, be battery-operated or use any other kind of suitable energy source, for example solar energy.

FIG. 1*a* shows a robotic cleaning device 10 according to an embodiment of the present invention from above, i.e. a top side of the robotic cleaning device is displayed. The robotic cleaning device 10 comprises a main body 11 housing a variety of components as will be discussed in more detail in the following. The main body 11 is further arranged, in a front portion 16, with a horizontally protruding member 33 on which a brush 24 is arranged. Advantageously, by arranging the robotic cleaning device, which in this particular exemplifying embodiment has a circular shape, with a protruding brush 24, its reach will be greatly improved and e.g. corners are much more effectively cleaned.

Figure 1B:
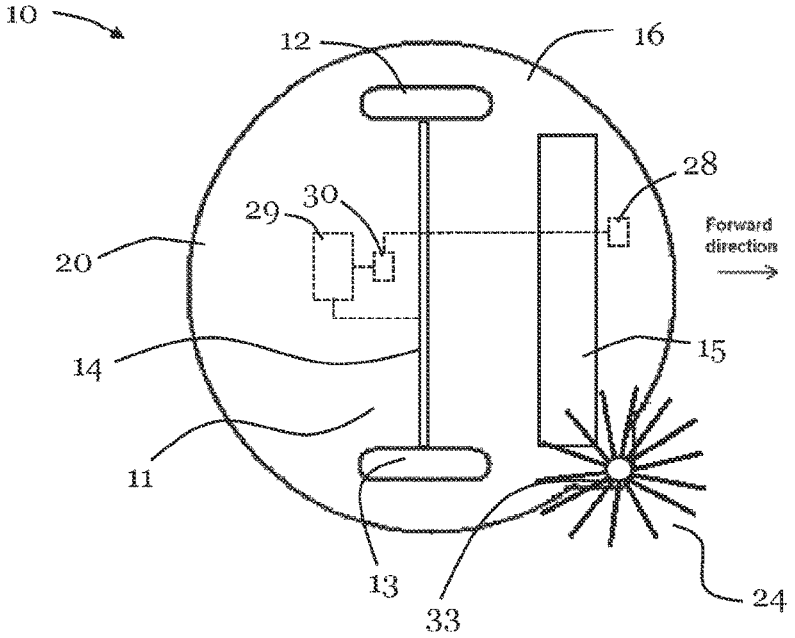
FIG. 1*b* shows the robotic cleaning device of FIG. 1*a* in a bottom view.

FIG. 1*b* shows the robotic cleaning device 10 of FIG. 1*a* from below, i.e. a bottom view is displayed. The robotic cleaning device 10 comprises a main body 11 housing components such as driving means 29 in the form of an electric motor for enabling movement of the driving wheels 12, 13 such that the cleaning device can be moved over a surface to be cleaned.

In this particular exemplifying illustration, the driving wheels 12, 13 are coaxially arranged along a drive shaft 14. The electric motor 29 is capable of controlling the driving wheels 12, 13 to rotate independently of each other in order to move the robotic cleaning device 10 across the surface to be cleaned. A number of different driving wheel arrangements can be envisaged.

Further, the main body 11 is arranged with a cleaning member 15 for removing debris and dust from the surface to be cleaned. This is in an embodiment of the present invention implemented by means of a suction fan (not shown) creating an air flow for transporting debris to a dust bag or cyclone arrangement housed in the main body via an opening in the bottom side of the main body 11. In a further embodiment, the cleaning member 15 could be embodied in the form of a rotatable brush roll vertically arranged in the opening to enhance the dust and debris collecting properties of the cleaning device 10. The main body 11 may further optionally comprise obstacle detecting means 28 for detecting obstacles in the form of walls, floor lamps, table legs, around which the robotic vacuum cleaning must navigate by having a controller 30 such as a microprocessor control the motor 29 to rotate the driving wheels 12, 13 as required in view of navigation information received by the obstacle detecting means. This will be further discussed subsequently. The obstacle detecting means 28 may be embodied in the form of infrared (IR) sensors and/or sonar sensors, a microwave radar, a camera registering its surroundings, a laser scanner, etc. for detecting obstacles and communicating information about any detected obstacle to the microprocessor 30 in order to have the motor 29 control movement of the wheels 12, 13 in accordance with navigation information provided by the obstacle detecting means 28.

Even though it would suffice to have the cleaning member 15, i.e. the opening in the bottom side of the main body 11 via which a suction fan creates an air flow and/or in which a rotatable brush roll possibly is arranged, arranged in the front end portion 16 adjacent to the brush 24, in an embodiment of the present invention, the opening (and possibly the brush roll) extends laterally in the main body 11 along a greater part of the front end portion 16. Thereby, the robotic cleaning device 10 advantageously cleans an area as wide as possible which contributes to reducing time (and energy consumption) needed to clean a surface. As can be seen in FIG. 1*b*, the brush 24 is in an embodiment a rotational brush with its centre of rotation arranged on a distance from the main body 11 thus enabling reaching into corners.

Figure 2A:
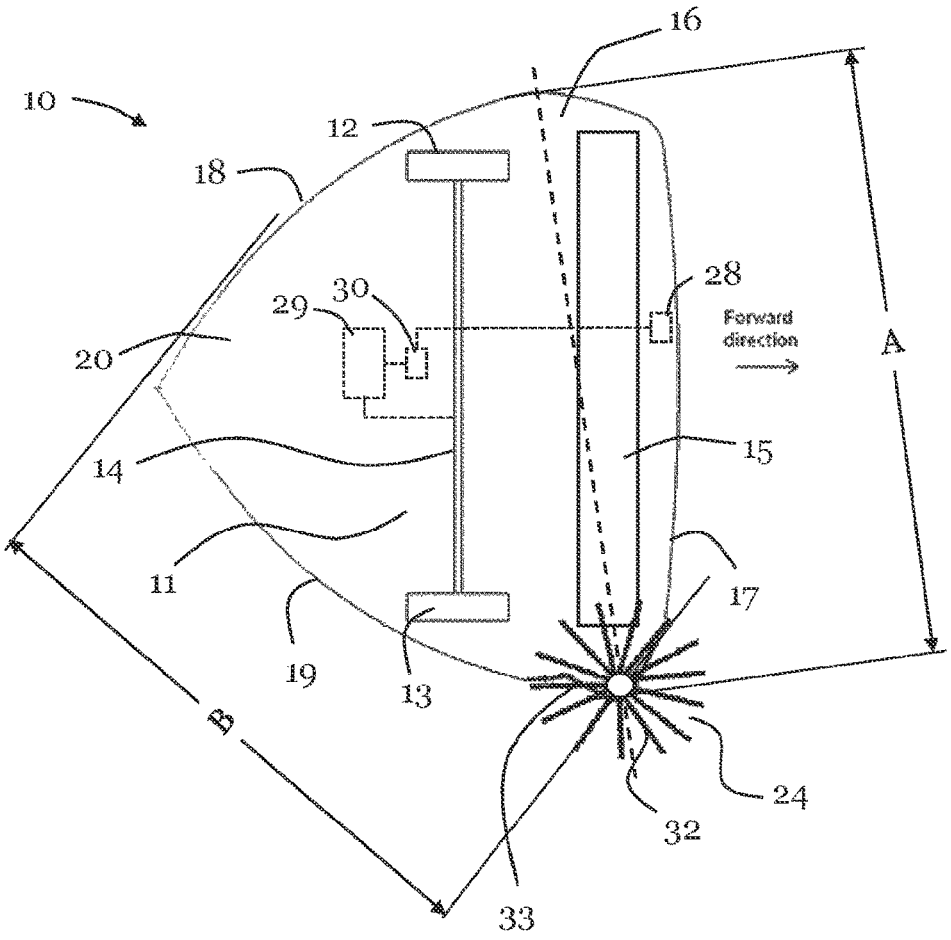
FIG. 2*a* shows a robotic cleaning device according to a further embodiment of the present invention in a bottom view.

FIG. 2*a* shows a robotic cleaning device 10 according to a further embodiment of the present invention in a bottom view. The robotic cleaning device 10 comprises a main body 11 housing components such as driving means 29 in the form of an electric motor for enabling movement of the driving wheels 12, 13 such that the cleaning device can be moved over a surface to be cleaned.

In this particular embodiment, the main body 11 has a front end portion 16 with a front end wall 17, a rear end portion 20, a right side wall 18 connecting the front end wall 17 and the rear end portion 20 and a left side wall 19 connecting the front end wall 17 and the rear end portion 20. The front end portion 16 of the main body 11 of the robotic cleaning device 10 is the portion of the main body 11 located between drive shaft 14 and a front end wall 17. In an embodiment of the present invention, the front end portion 16 is essentially quadrilateral-shaped, possibly with slightly rounded corners where the front end wall 17 meets the right side wall 18 and the left side wall 19, respectively. The front end wall 17 is flat or slightly curved as shown in FIG. 2*a* in order to reach far into corners. As previously mentioned, the rotating brush 24 arranged on the protruding member 33 is advantageous for increasing the reach of the robotic cleaning device 10.

In yet a further embodiment, again with reference to FIG. 2*a*, the main body 11 of the robotic cleaning device is arranged such that its width A is greatest laterally between an outermost point 32 of the horizontally protruding member 33 and the oppositely located side wall 18 (in this case being the left side wall) at the front end portion 16 of the main body, which is illustrated by means of the dotted line. The shape of the main body 11 of FIG. 2*a* is generally referred to as a three-lobed form. Thus, the width A is the greatest distance measured across the main body 11, advantageously facilitating navigation of corners and narrow spaces such as corridors. Hence, the width A is greater than or equal to width B defined from a rear end portion 20 of the main body 11 to the front end wall 17.

Now, if the greatest width A is located closer to the drive shaft 14, i.e. the greatest width coincides with the rotational axis of the drive shaft 14, it will have the advantage that the geometry of the main body 11 will be adapted to turn around in a narrow space (such as a narrow corridor, as will be illustrated herein below). If on the other hand the greatest width A is located closer to the front end wall, it will have the advantage that the cleaning member 15 can be made as long as possible in a lateral direction of the main body 11. In practice, a compromise can be made by shaping the main body such that the greatest width A is located somewhere between the shaft 14 and the front end wall 17.

In FIG. 2*a*, the back of the rear end portion 20 is pointed, meaning that the rear end portion 20 is formed by the right side wall 18 and the left side wall 19 connecting at the back of the rear end portion. However, it is possible that the back of the rear end portion 20 alternatively is flat or slightly curved, in which case a rear end wall would connect to the right side wall 18 and the left side wall 19, respectively, and form the back of the rear end portion 20.

Figure 2B:
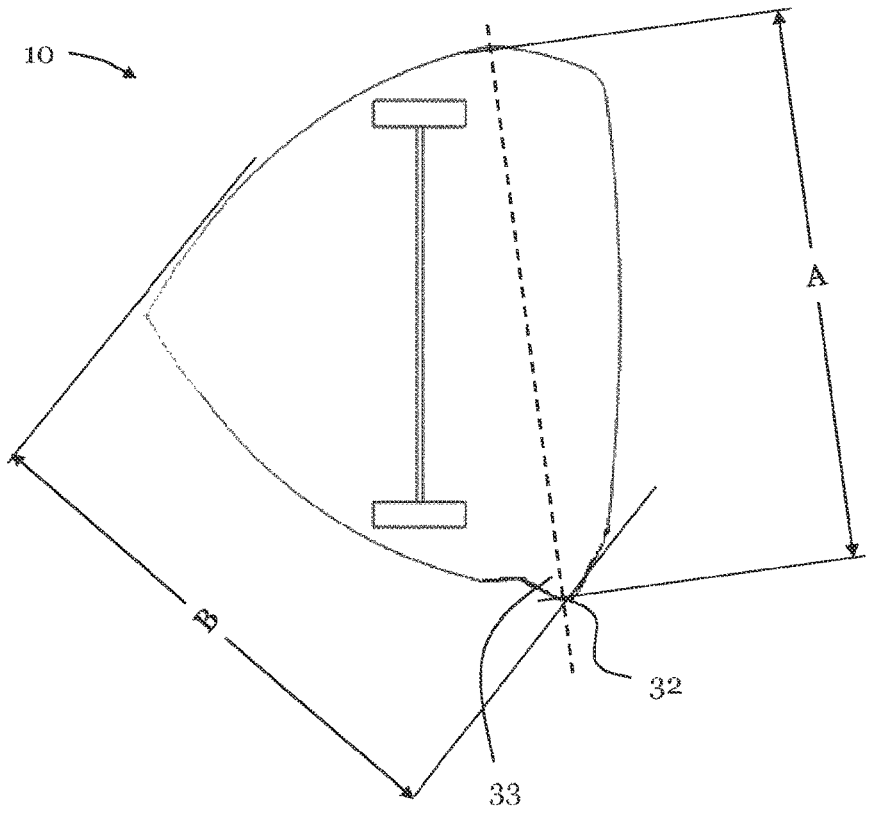
FIG. 2*b* shows the contour of the main body of the robotic cleaning device of FIG. 2*a* in a bottom view.

FIG. 2*b*, shows the robotic cleaning device 10 according to the embodiment of FIG. 2*a*, but without the rotating brush 24 in order to clearly illustrate the outer-most point 32 of the protruding member 33.

Figure 3:
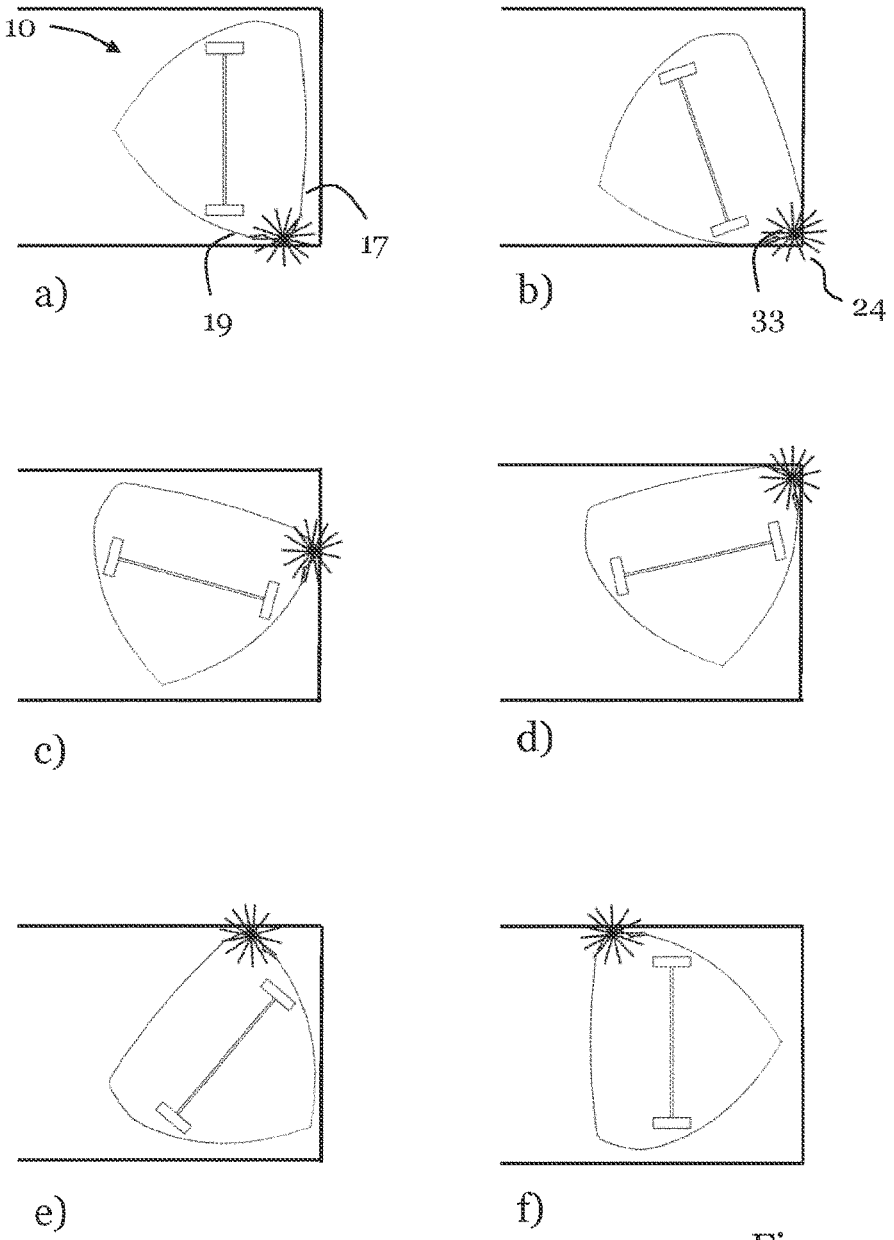
FIG. 3 illustrates a sequence a-f of movements of the robotic cleaning device of FIG. 2*a* navigating into and out of two corners in a narrow corridor in a bottom view.

FIG. 3 illustrates a bottom view sequence a-f of movements of the robotic cleaning device 10 of the embodiment of the present invention as shown in FIG. 2 navigating into and out of two corners in a narrow corridor. In FIG. 3*a*, the robotic cleaning device navigates into the corner via a wall leading into the corner. The front end wall 17 of the main body faces the wall leading out of the corner while the left side wall 19 faces the wall leading into of the corner. It should be noted that in practice, the front end wall 17 and side end walls 18, 19, are not flush against the walls of the corner to be cleaned, but the robotic cleaning device 10 is generally navigated such that they are located approximately 2-10 mm from the walls.

In FIG. 3*b*, the robotic cleaning device 10 is rotated such that the curved left side wall 19 follows the wall leading into the first corner while the front end wall 17 at one of its outer ends follows the wall leading out of the corner. Further, it can be seen that the protruding member 33 reaches all the way into the first corner, thereby enabling for the brush 24 to sweep debris out of the corner such that the cleaning member of the robotic cleaning device can remove the debris. The rotation continues in FIG. 3*c*, where the protruding member 33 practically is flush against the wall.

With reference to FIG. 3*d*, it can be seen that the protruding member 33 reaches all the way into the second corner, thereby enabling for the brush 24 to sweep debris out of the corner such that the cleaning member of the robotic cleaning device can remove the debris. In FIG. 3*e*, the robotic cleaning device 10 moves out of the second corner and finally in FIG. 3*f*, the cleaning device has made a 90-degree turn in the second corner and is ready to pursue the wall leading out of the corner or make another 90-degree turn.

Figure 4:
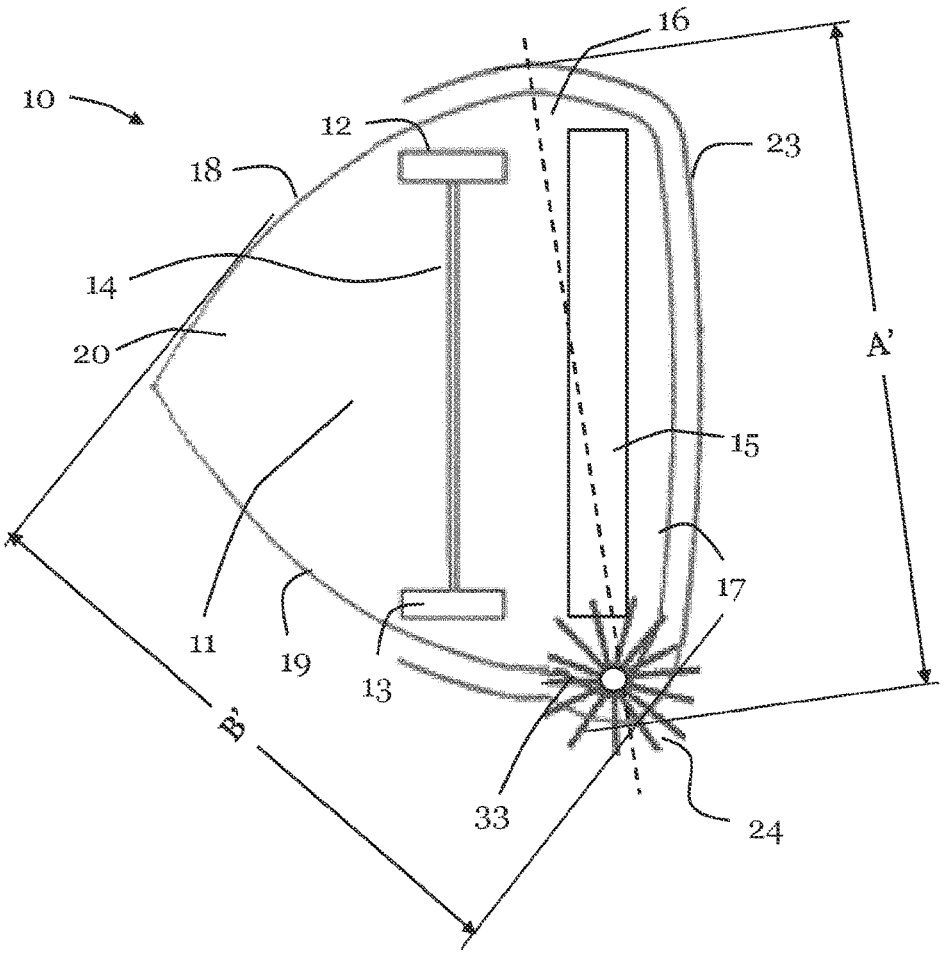
FIG. 4 shows a robotic cleaning device comprising a flexible bumper according to another embodiment of the present invention in a bottom view.

Thus, as can be deduced from FIG. 3, the robotic cleaning device 10 according to the present invention advantageously navigates corners and difficult-to-access spaces like narrow corridors while still navigating very close to the walls leading into and out of the corners, thereby facilitating removal of debris from the floor at a very close range from the walls. The symmetry of the main body 11 further allows the robotic device 10 to take a corner from either a right or a left direction with the same cleaning effect, should the main body 11 be arranged with two protruding members 33 and brushes 24, one of each at each side of the front end wall 17. FIG. 4 illustrates still another embodiment of the present invention, where the robotic cleaning device 10 further comprises a flexible bumper 23. It should be noted that the greatest width A' of the main body 11 is at the same location in the front end portion 16 as for the embodiment shown in FIGS. 2*a* and *b*. Further, for illustrative purposes, the distance between the bumper 23 and the front end portion 16 is somewhat exaggerated; in practice the bumper 23 is arranged flush against the front end wall 17. In analogy with FIG. 2*a*, the lateral width A' from the right side wall 18 to the outermost point of the protruding member 33 is greater than the width B' taken from bumper 23 arranged at the front end wall 17 to the right side wall 18. The flexible bumper 23 covers at least the front end portion 16 of the main body 11, and extends in an embodiment of the present invention to the rotational axis of the drive shaft 14 on which the driving wheels 12, 13 are coaxially arranged. Thus, as long as the robotic cleaning device 10 rotates or moves forward, the only part of the main body 11 that can run into obstacles is the bumper 23, implying that collisions with all obstacles can be detected by the bumper 23. Further, since the bumper 23 is flexible, it will press resiliently against the front end wall 17 when contacting obstacles, thus mitigating the thrusting effect it has on obstacles in its way and reducing the risk that the obstacles will be displaced, tip over and/or be damaged.

As previously mentioned, the robotic cleaning device 10 according to an embodiment of the present invention comprises obstacle detecting means, which in an embodiment are implemented by means of the bumper 23 being flexibly mounted to the main body 11. The bumper cooperates with one or more sensors (not shown) registering when the robotic cleaning device 10 runs against an obstacle thus causing pressing of the bumper 23 against the main body 11. The bumper 23 and the sensor(s) hence function as obstacle detecting means communicating with the microprocessor arranged in the main body 11 to control the cleaning device motor to rotate the driving wheels 12, 13 as required in view of navigation information received by the obstacle detecting means.

Figure 5A:
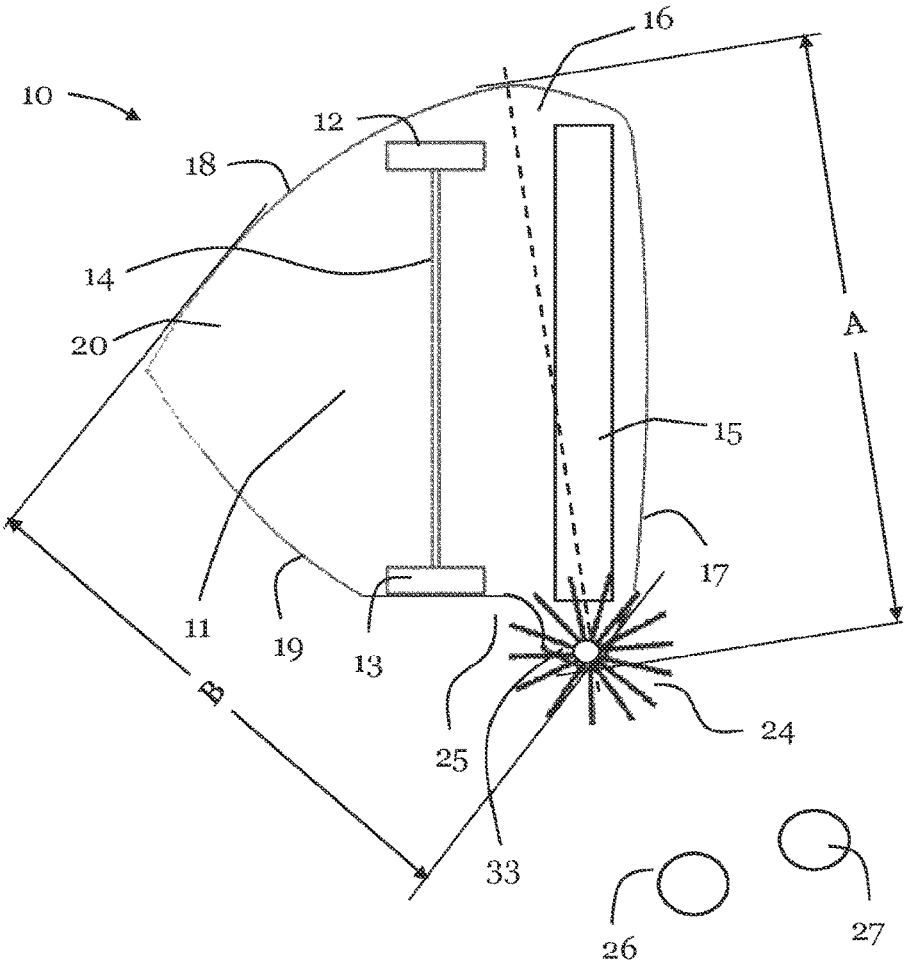
FIG. 5*a* shows a robotic cleaning device comprising an indentation adjacent to the protruding member according to a further embodiment of the present invention in a bottom view.

FIG. 5*a* shows still another embodiment of the present invention, where the robotic cleaning device 10 shown in FIG. 4 further is arranged with an indentation 25 or cut-in right behind the rotatable side brush 24. This is advantageous since the side brush 24 can reach around the periphery of smaller obstacles, such as chair legs 26, 27. Further, should the robotic cleaning device 10 comprise two side brushes, a respective indentation is arranged at the side brushes. The main body 11 of the robotic cleaning device 10 is arranged such that its width A is greatest laterally between the right side wall 18 and the left side wall 19 at the front end portion 16 of the main body, which is illustrated by means of the dotted line (i.e. the same width as that illustrated in FIGS. 2*a* and *b*). Thus, the width A is the greatest distance measured across the main body 11, advantageously facilitating navigation of corners. Hence, the width A is greater than or equal to width B defined from a rear end portion 20 of the main body 11 to the front end wall 17.

Figure 5B:
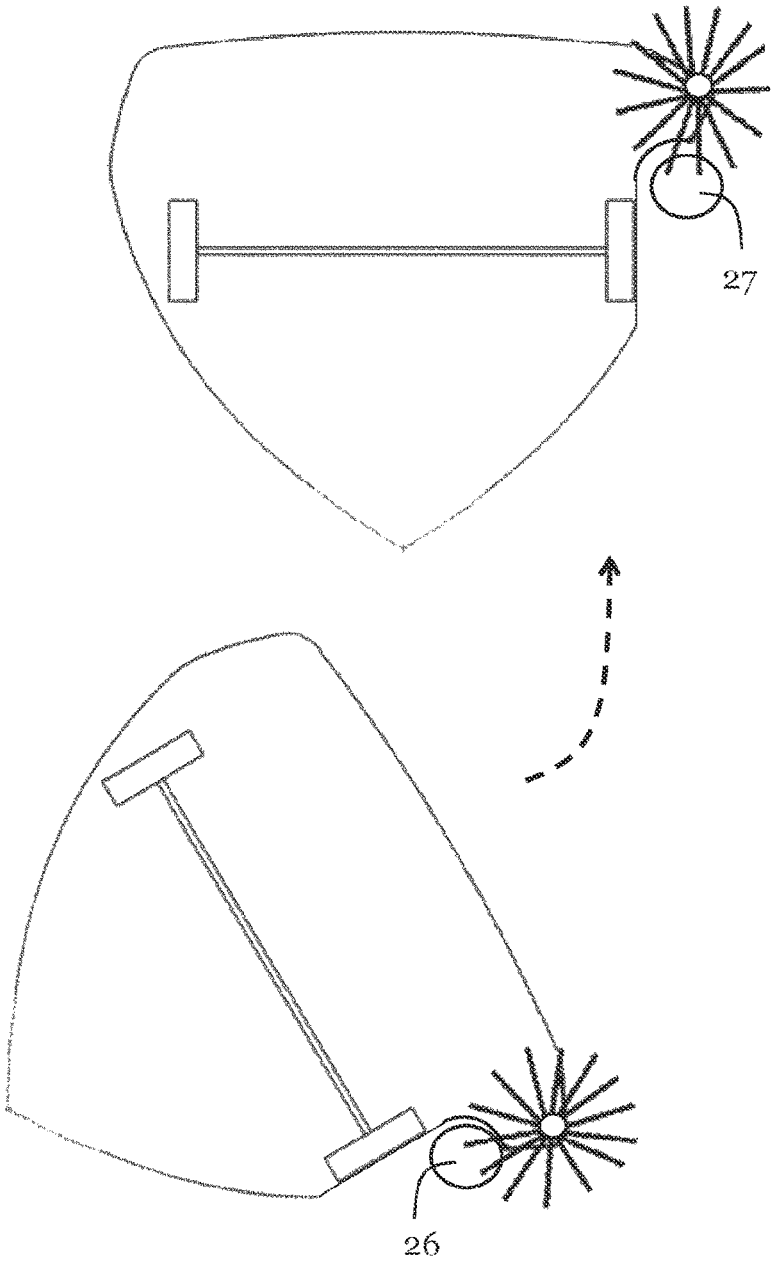
FIG. 5*b* shows the robotic cleaning device according to FIG. 5*a* when cleaning around small objects in a bottom view.

FIG. 5*b* shows how the robotic cleaning device according to the embodiment discussed in FIG. 5*a* moves such that first object 26 is placed in the indentation such that the side brush can each around and clean the first object 26. Thereafter, the robotic cleaning device moves towards a second object 27 and places it in the indentation such that cleaning around the second object 27 can be undertaken.

Figure 6:
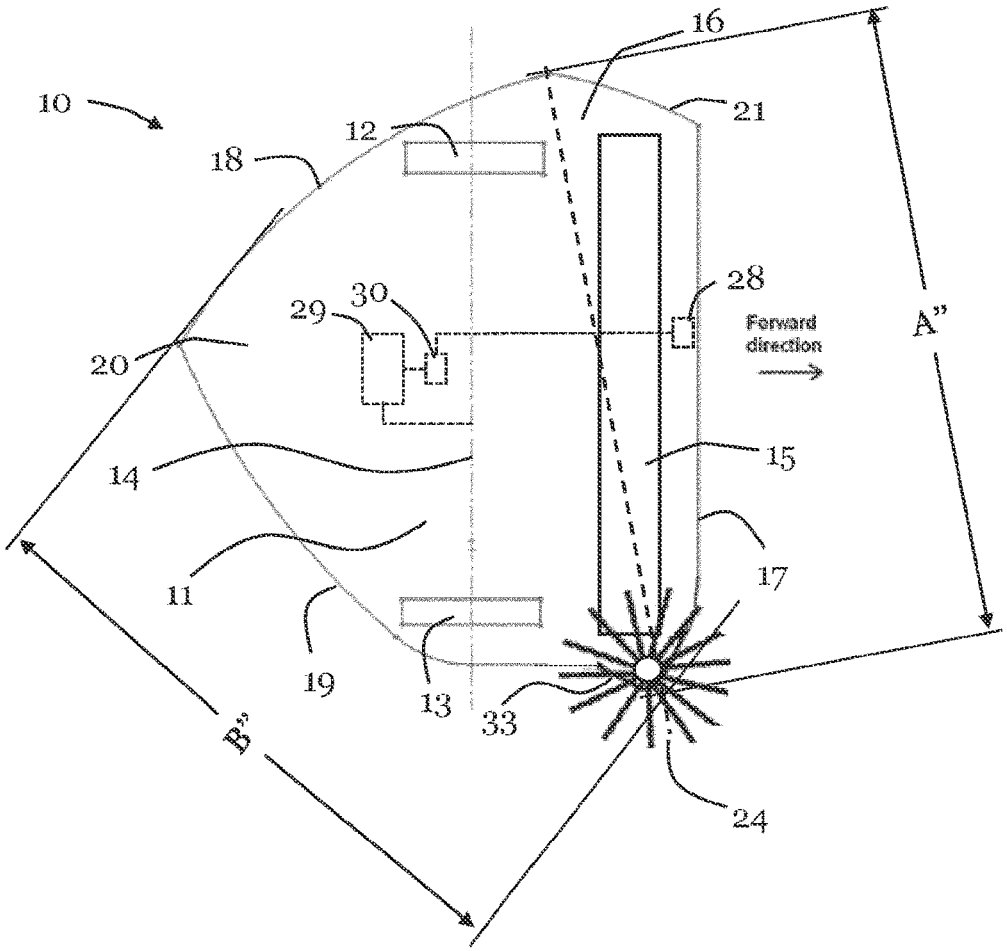
FIG. 6 shows a robotic cleaning device according to a further embodiment of the present invention in a bottom view.

FIG. 6 shows a robotic cleaning device 10 according to a further embodiment of the present invention. In contrast to the embodiment shown e.g. in FIGS. 2*a* and *b* (when omitting the protruding member 33), the contour of the main body 11 of the robotic cleaning device 10 is in this particular embodiment asymmetric. The main body 11 of the robotic cleaning device 10 is arranged such that its width A" is greatest laterally between the right side wall 18 and the outermost point of the protruding member 33 on which the rotating brush 24 is arranged, which is illustrated by means of the dotted line. Thus, the width A" is the greatest distance measured across the main body 11, advantageously facilitating navigation of corners. Hence, the width A" is greater than or equal to width B" defined from a rear end portion 20 of the main body 11 to the front end wall 17.

The robotic cleaning device 10 according to the embodiment shown in FIG. 6 could further be arranged with an indentation 25 as previously discussed with reference to FIGS. 5*a* and *b*.

Even though the invention has been described with reference to specific exemplifying embodiments thereof, many different alterations, modifications and the like will become apparent for those skilled in the art. The described embodiments are therefore not intended to limit the scope of the invention, as defined by the appended claims.

The invention claimed is:

1. A robotic cleaning device comprising:

a main body having:

a wheel axis extending in a lateral direction, a drive axis extending perpendicular to the wheel axis, a front end portion located in front of the wheel axis, a rear end portion located behind the wheel axis, a first perimeter sidewall extending along and connecting the front end portion and the rear end portion on a first side of the drive axis, a second perimeter sidewall extending along and connecting the front end portion and the rear end portion on a second side of the drive axis, a laterally protruding member extending from the first perimeter sidewall along the lateral direction in the front end portion of the main body, wherein the main body has a generally triangular shape defined by a width (A) and a width (B), wherein width (A) is a greatest width of the main body as defined between an outermost point of the laterally protruding member and a point on the second perimeter sidewall located in the front end portion, and width (B) is a width of the main body as defined between the outermost point of the laterally protruding member and a point on the second perimeter sidewall located in the rear end portion, where width (A) is greater than width (B);

at least one driving wheel arranged on the main body on the wheel axis and configured to movably support the robotic cleaning device on a surface to be cleaned;

a cleaning member including an opening in the main body arranged at a bottom side in the front end portion of the main body for removing debris from the surface to be cleaned; and a brush arranged at a bottom side of the laterally protruding member for removing debris from the surface to be cleaned.

2. The robotic cleaning device of claim 1, wherein the first perimeter sidewall and the second perimeter sidewall are curved.

3. The robotic cleaning device of claim 2, wherein the first perimeter sidewall forms a first arc of a circular shape and the second perimeter sidewall forms a second arc of the circular shape.

4. The robotic cleaning device of claim 1, wherein the main body comprises a front wall joining the first perimeter sidewall to the second perimeter sidewall in the front end portion of the main body, the front wall being generally straight.

5. The robotic cleaning device of claim 1, further comprising an indentation in the first perimeter sidewall behind the laterally protruding member.

6. The robotic cleaning device of claim 1, further comprising an obstacle detecting means arranged to detect obstacles and provide a control means with navigation information for enabling navigation of the robotic cleaning device.

7. The robotic cleaning device of claim 6, wherein the obstacle detecting means comprises a flexible bumper and at least one sensor with which the flexible bumper is arranged to cooperate in order to register the robotic cleaning device contacting an obstacle.

8. The robotic cleaning device of claim 1, further comprising a bumper mounted to the main body and configured to press resiliently against the main body upon the robot cleaning device contacting an obstacle.

9. The robotic cleaning device of claim 8, wherein the bumper surrounds the front end portion of the main body.

10. The robotic cleaning device of claim 8, wherein the bumper extends from a first end located along the first perimeter sidewall proximate to the wheel axis, to a second end located along the second perimeter sidewall proximate to the wheel axis.

11. The robotic cleaning device of claim 8, further comprising one or more sensors configured to detect when the bumper presses resiliently against the main body.

12. The robotic cleaning device of claim 1, wherein the at least one driving wheel comprises a pair of coaxially arranged driving wheels mounted on the wheel axis, each driving wheel being located adjacent a respective one of the first perimeter sidewall and the second perimeter sidewall.

13. The robotic cleaning device of claim 1, wherein the brush comprises a rotating brush.

14. The robotic cleaning device of claim 13, wherein the rotating brush comprises radially extending arms that extend beyond an outer perimeter of the main body.

15. The robotic cleaning device of claim 1, further comprising a cleaning member extending along the bottom side of the front end portion of the main body, the cleaning member comprising one or more of a rotatable brush roll and an opening connected to a suction fan.

16. The robotic cleaning device of claim 15, wherein the cleaning member is arranged adjacent to the front end portion and at a location on the main body adjacent the greatest width of the main body.

17. The robotic cleaning device of claim 1, wherein the brush overlaps the opening of the cleaning member.

18. The robotic cleaning device of claim 1, wherein the laterally protruding member has an asymmetrical shape.

19. The robotic cleaning device of claim 1, wherein the drive axis is parallel to the front wall of the generally triangular shape.

* * * * *